US012006486B2

(12) United States Patent
Coultas et al.

(10) Patent No.: US 12,006,486 B2
(45) **Date of Patent: *Jun. 11, 2024**

(54) METHOD OF LIMITING CHEMICAL DEGRADATION DUE TO NITROGEN DIOXIDE CONTAMINATION

(71) Applicant: Infineum International Limited, Oxford (GB)

(72) Inventors: David Robert Coultas, Abingdon (GB); Matthew David Irving, Abingdon (GB); Nathan Hollingsworth, Abingdon (GB); Adam Greer, Abingdon (GB); Christopher Hardacre, Abingdon (GB)

(73) Assignee: Infineum International Limited, Oxford (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/049,730

(22) Filed: Oct. 26, 2022

(65) Prior Publication Data

US 2023/0139911 A1 May 4, 2023

(30) Foreign Application Priority Data

Oct. 29, 2021 (EP) ..... 21205654

(51) Int. Cl.
*C10M 137/10* (2006.01)
*C10M 133/38* (2006.01)
(Continued)

(52) U.S. Cl.
CPC ..... *C10M 137/10* (2013.01); *C10M 133/38* (2013.01); *C10M 2215/22* (2013.01);
(Continued)

(58) Field of Classification Search
CPC ..... C10M 133/06; C10M 137/12; C10M 169/04; C10M 171/00; C10M 133/38;
(Continued)

(56) References Cited

U.S. PATENT DOCUMENTS 3,024,195 A 3/1962 Drummond et al.
3,024,237 A 3/1962 Drummond et al.
(Continued)

FOREIGN PATENT DOCUMENTS

EP 2090642 A1 8/2009
WO 2008075016 A1 6/2008
(Continued)

OTHER PUBLICATIONS

European Search Report Application No. 21205654.3.
(Continued)

*Primary Examiner* — Vishal V Vasisth
(74) *Attorney, Agent, or Firm* — Robert A. Migliorini; Catherine L. Bell

(57) ABSTRACT

A method of limiting the chemical degradation of hydrocarbonaceous liquids due to nitrogen dioxide contamination at elevated temperature comprises the addition thereto of an ionic liquid composed of a cation and a boron- and halogen-free, multi-functional aromatic anion, the ionic liquid serving to inhibit the nitration of hydrocarbonaceous liquid components that initiates degradation.

17 Claims, 2 Drawing Sheets

Nitration peak heights measured during the testing of Example 4

(51) Int. Cl.
*C10N 30/00* (2006.01)
*C10N 40/25* (2006.01)
*C10N 70/00* (2006.01)

(52) U.S. Cl.
CPC ... *C10M 2223/065* (2013.01); *C10N 2030/78* (2020.05); *C10N 2040/25* (2013.01); *C10N 2070/02* (2020.05)

(58) Field of Classification Search
CPC ..... C10M 2203/003; C10M 2207/144; C10M 2217/144; C10M 2217/028; C10M 2219/044; C10M 2223/045
See application file for complete search history.

(56) References Cited

U.S. PATENT DOCUMENTS

| | | | |
|---|---|---|---|
| 3,087,936 | A | 4/1963 | Suer |
| 3,113,986 | A | 12/1963 | Breslow et al. |
| 3,154,560 | A | 10/1964 | Osuch |
| 3,172,892 | A | 3/1965 | Le Suer |
| 3,202,678 | A | 8/1965 | Stuart et al. |
| 3,216,936 | A | 11/1965 | Le Suer |
| 3,219,666 | A | 11/1965 | Norman et al. |
| 3,254,025 | A | 5/1966 | Le Suer |
| RE27,145 | E | 6/1971 | Jones |
| 3,634,595 | A | 1/1972 | Pasquali |
| 3,670,054 | A | 6/1972 | De La Mare et al. |
| 3,700,633 | A | 10/1972 | Wald et al. |
| 6,153,565 | A | 11/2000 | Skinner et al. |
| 6,191,081 | B1 | 2/2001 | Cartwright et al. |
| 6,281,179 | B1 | 8/2001 | Skinner et al. |
| 6,429,178 | B1 | 8/2002 | Skinner et al. |
| 8,278,253 | B2 | 10/2012 | Habeeb |
| 9,278,134 | B2 | 3/2016 | Rogers et al. |
| 2008/0251759 | A1 | 10/2008 | Kalb et al. |
| 2010/0084597 | A1* | 4/2010 | Schwab ..... C10M 171/004 508/528 |
| 2010/0187481 | A1 | 7/2010 | Bodesheim et al. |
| 2010/0216675 | A1 | 8/2010 | Habeeb |
| 2012/0101012 | A1 | 4/2012 | Delbridge et al. |
| 2012/0184474 | A1* | 7/2012 | Kawata ..... C07C 69/44 560/182 |
| 2016/0024421 | A1 | 1/2016 | Qu et al. |
| 2023/0139253 | A1 | 5/2023 | Coultas et al. |
| 2023/0140105 | A1 | 5/2023 | Coultas et al. |

FOREIGN PATENT DOCUMENTS

| | | | |
|---|---|---|---|
| WO | 2013158473 | A1 | 10/2013 |
| WO | 2022026432 | A1 | 3/2022 |

OTHER PUBLICATIONS

European Search Report Application No. 21205659.2.
European Search Report Application No. 21205667.5.
Reeves et al., CJ, Journal of Cleaner Production, "Tribological performance of environmental friendly ionic liquids for high-temperature applications," vol. 279, pp. 1-14, 2021, 123666.
Coultas, D.R. "The Role of NOx in Engine Lubricant Oxidation" SAE Technical Paper 2020-0101427, 2020. doi:10.4271/2020-01-1427.
American Petroleum Institute (API) publication "Engine Oil Licensing and Certification System", Industry Services Department, Fourteenth Edition, Dec. 1996, Addendum 1, Dec. 1998.

* cited by examiner

FIGURE 1 – Gravimetric measurement of nitrogen dioxide uptake by ionic liquids in Example 2
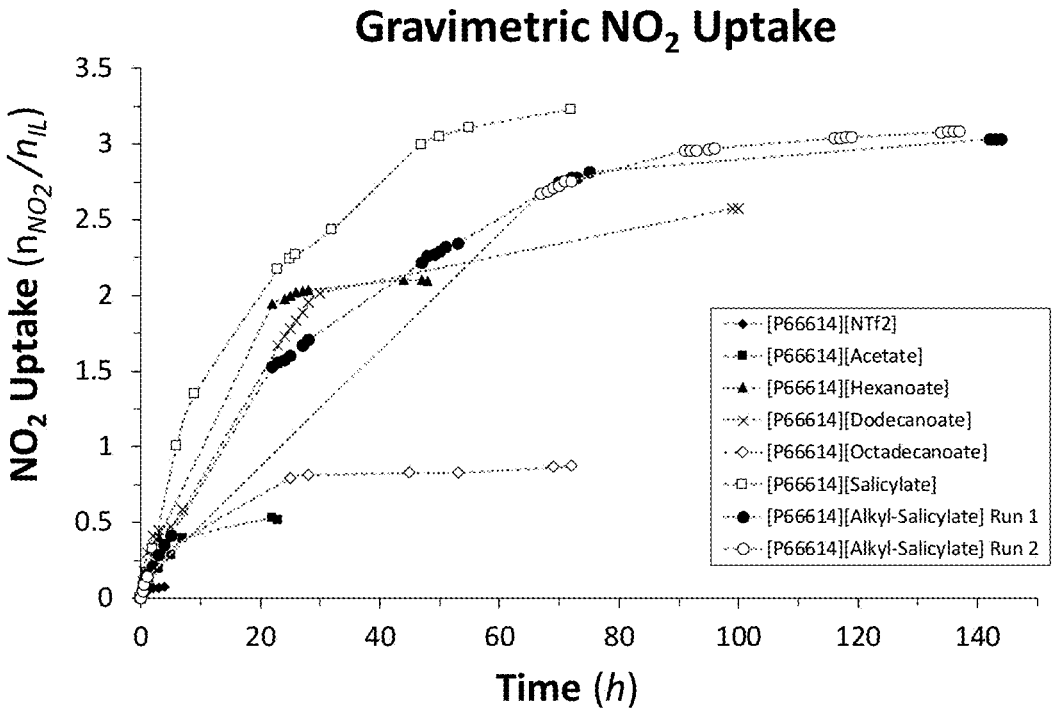
FIGURE 2 – Nitration peak heights measured during the testing of Example 4
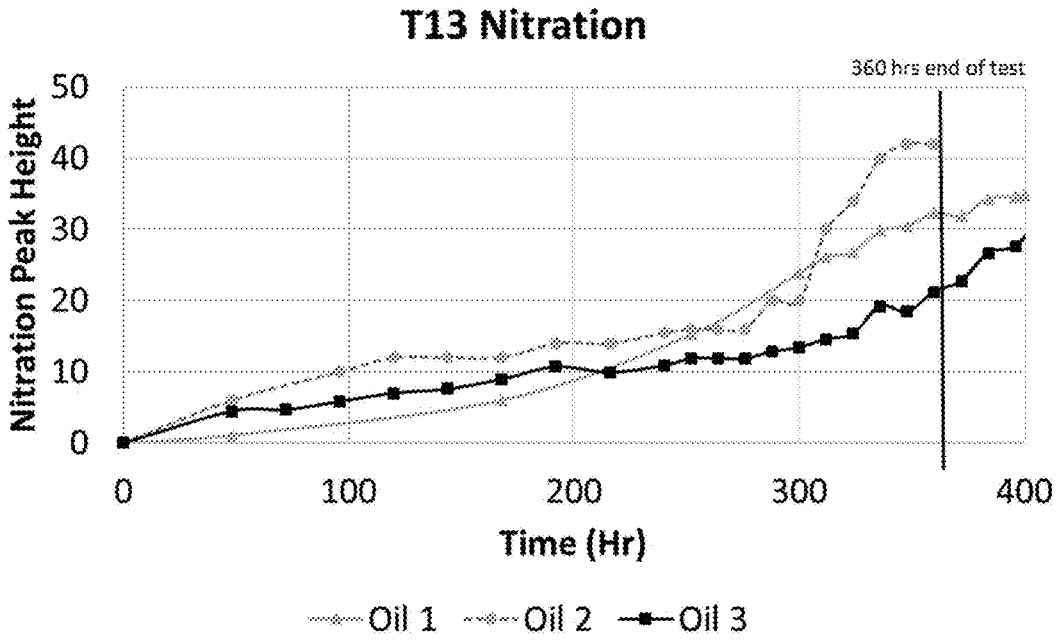

Figure 3 – Oxidation peak heights measured during the testing of Example 4
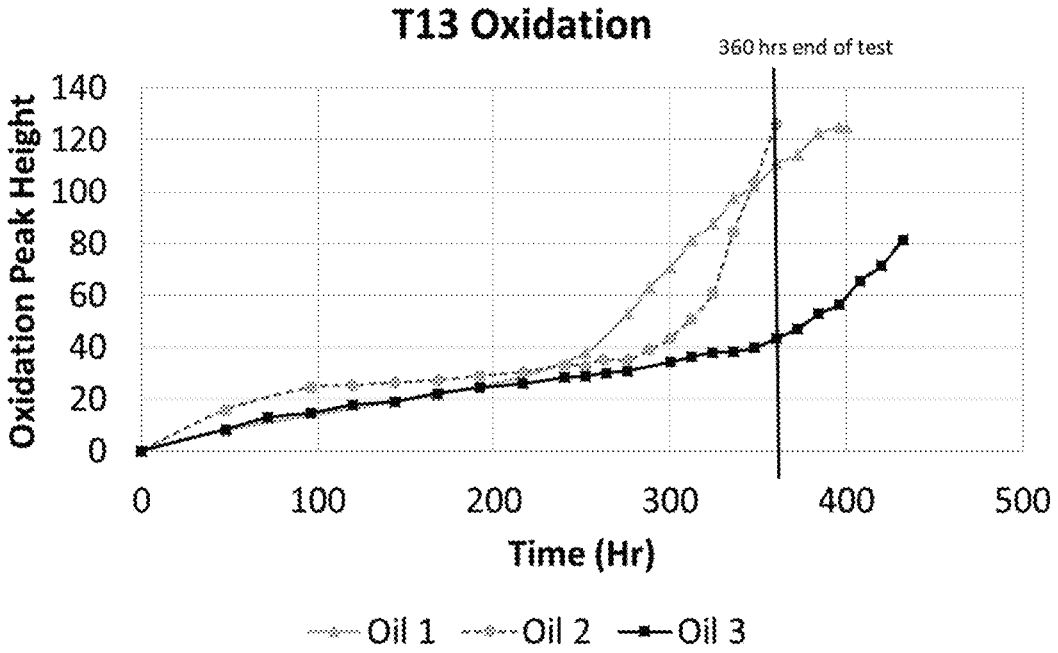
Figure 4 – Kinematic viscosity at 100°C measured during the testing of Example 4
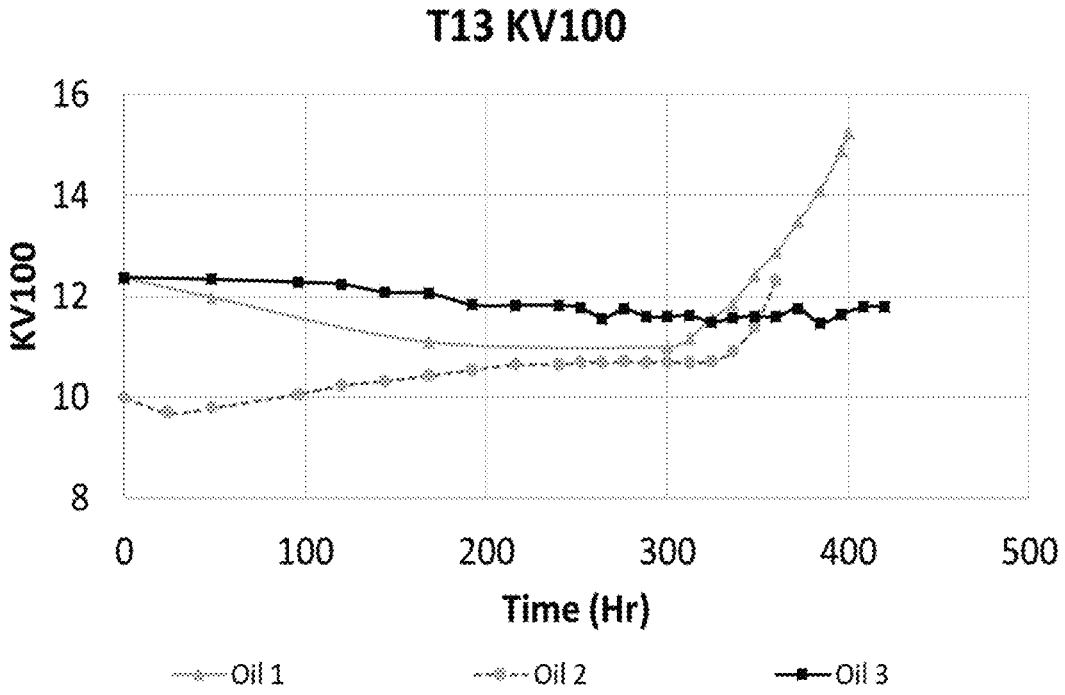

METHOD OF LIMITING CHEMICAL DEGRADATION DUE TO NITROGEN DIOXIDE CONTAMINATION

PRIORITY CLAIM

This invention claims priority from European Patent Application EP21205654.3, filed Oct. 29, 2021, in the European Patent Office.

CROSS REFERENCE TO RELATED APPLICATIONS

This application is related to:

1) Concurrently filed U.S. Ser. No. 18/049,733, having entitled "Ionic liquid composition" and claiming priority to EP21205659.2, filed Oct. 29, 2021, in the European Patent Office; and 2) Concurrently filed U.S. Ser. No. 18/049,737, having entitled "Method of limiting chemical degradation due to nitrogen dioxide contamination" and claiming priority to EP21205667.5, filed Oct. 29, 2021, in the European Patent Office.

FIELD OF THE INVENTION

The present invention concerns a method of limiting the chemical degradation of hydrocarbonaceous liquids due to nitrogen dioxide contamination in service at elevated temperatures. The method essentially comprises the addition to the hydrocarbonaceous liquid of an additive quantity of a defined ionic liquid, the ionic liquid serving to inhibit the nitration of the hydrocarbonaceous liquid by nitrogen dioxide which initiates the degradation.

BACKGROUND OF THE INVENTION

Hydrocarbonaceous liquids are used as service fluids in a variety of hardware applications, and in particular are used as lubricants, protective agents, hydraulic fluids, greases and heat transfer fluids for engineered parts and devices. The composition and properties of such liquids are selected for their intended application, and the ready availability of higher molecular weight hydrocarbonaceous species allows such fluids to be formulated for service at elevated temperatures, in particular above 100° C. where aqueous fluids cease to be usable.

Such hydrocarbonaceous liquids may typically be derived from petroleum or synthetic sources, or from the processing of biomaterials. In particular, hydrocarbonaceous lubricants and hydraulic fluids have become the standard in a variety of applications, including automotive and power transmission fluids, such as engine lubricating oils.

An essential performance attribute of service liquids is their ability to retain beneficial properties over their service life. The rigours of service place physical and chemical strains on the liquid, and limiting the resulting degradation of the liquid is a major consideration in their selection and formulation. Service fluids typically have to meet a number of performance requirements in their development and certification relating to maintaining service life, which expose the candidate liquids to testing under relevant service conditions which promote degradation.

Elevated service temperatures and the presence of chemically reactive contaminants increase the demands on hydrocarbonaceous liquids. Higher bulk liquid temperatures and the build-up of reactive contaminants can promote degradation reactions and cause serious reductions in service life, leaving the surrounding hardware inadequately served or protected by the liquid.

There exists in the art a general need to improve the service life of hydrocarbonaceous liquids operating at elevated bulk temperatures, and particularly of lubricants, by providing improved resistance to chemical degradation in the bulk under service conditions.

Degradation of hydrocarbonaceous liquids, especially at elevated bulk temperature, has typically been referred to in the art as 'oxidation', based on the conventional understanding that the chemical reactions responsible for degradation essentially involve the reaction of aging hydrocarbon species with oxygen, via a free-radical pathway involving peroxides formed in situ during service. The build-up of these species over time leads to increasing degradation of the liquid and deterioration in bulk liquid properties and service performance. A variety of additives conventionally designated 'anti-oxidants' have been proposed in the art to inhibit this oxidation pathway, including hydrocarbon-soluble hindered phenols and amines, slowing the resulting oxidative degradation that builds as the fluid ages in service.

However, work by the present applicant has characterised a different chemical degradation pathway that manifests itself in freshly prepared hydrocarbonaceous fluids lacking aged components. This degradation is initiated not by reaction with oxygen or peroxides, but from the direct chemical action at elevated temperatures of nitrogen dioxide which has become entrained in the liquid through contamination in service. It has been found that nitrogen dioxide initiates chemical degradation via nitration reactions with the hydrocarbonaceous liquid, and that these reactions result in substantial breakdown of the liquid in a process which commences when the liquid is still fresh. Nitrogen dioxide can also oxidise to nitric acid within the bulk liquid environment, and lead to acidic attack of the liquid and hardware it is designed to protect. Consequently, there is a specific need to limit the degradative effect of nitrogen dioxide contamination in hydrocarbonaceous liquids at elevated temperatures, which can cause deterioration at an early stage of service life and can also compound the issues caused by conventional oxygen-driven oxidation.

Such contamination by nitrogen dioxide occurs where the hydrocarbonaceous liquid is exposed to a source of nitrogen dioxide during service. Nitrogen dioxide (NO2) is formed through the reaction of naturally occurring nitrogen and oxygen in air when exposed to higher temperatures, often via the intermediate formation of nitrogen oxide (NO), for example during combustion reactions. Nitrogen dioxide is also a combustion product of fuels derived from petroleum or many bio-sources, both of which contain an amount of bound nitrogen, which is released as nitrogen dioxide upon complete combustion and can become entrained in service liquids in contact therewith. Such exposure is particularly prevalent in combustion devices, for example internal combustion engines, which generate nitrogen dioxide and are lubricated by hydrocarbonaceous liquids that become exposed to the exhaust gases; and in particular in crankcase lubricating oils, which experience direct contact with exhaust gases whilst resident on engine surfaces in the cylinder region, and also via blow-by exhaust gases which direct nitrogen dioxide past the piston rings into the crankcase oil reservoir, where it becomes entrained with the lubricant.

Modern engine and aftertreatment developments aimed at improving the fuel efficiency of engines and minimising carbonaceous particulate emissions have led to higher combustion temperatures, resulting in the production of higher nitrogen dioxide levels in engine-out exhaust gas by virtue of the effect known as the 'NOx-Particulate trade off'. The higher engine temperatures also result in higher bulk lubricant service temperatures, leading to conditions in which the chemical degradation initiated by nitrogen dioxide is increased.

In addition, the modern focus on increased fuel economy from internal combustion engines has resulted in designs in which internal friction is reduced by engineering greater clearances between the piston rings and cylinder liner surfaces, resulting in free-running engines in which more exhaust gas blows by the piston rings into the crankcase, where it becomes entrained in the bulk engine lubricant.

Accordingly, hydrocarbonaceous liquids exposed to contamination by nitrogen dioxide in service at elevated temperatures face a particular challenge, due to a chemical nitration pathway that takes effect early in the life of the liquid and is not initiated by the conventional oxidation of hydrocarbons. This challenge is especially severe in the case of engine lubricants, where a variety of engineering measures have increased the degree of nitrogen dioxide entrainment into the bulk lubricant at elevated operating temperatures. The applicant has determined that the resulting nitration pathway is particularly evident at bulk liquid temperatures of between 60 and 180° C., and particularly severe at bulk liquid temperatures of between 110 and 160° C., which temperatures are becoming more evident in crankcase lubricants used under severe operating conditions or in modern, hotter-running engine designs, thus exacerbating the impact of this chemical pathway on lubricant degradation.

The present invention provides a solution to this challenge through the deployment of a defined ionic liquid additive having the particular ability to deactivate nitrogen dioxide, and thus inhibit the nitration of the hydrocarbonaceous liquid. Through this action, the defined ionic liquid additive limits the chemical degradation initiated by nitration and improves the hydrocarbonaceous liquid's service life.

One physical consequence of chemical degradation in hydrocarbonaceous service liquids is an increase in liquid viscosity during service. This viscosity increase can lead to the liquid no longer satisfying specified viscosity criteria, prompting its premature replacement. Deployment of the ionic liquid defined in this invention furthermore provides the advantage of limiting the viscosity growth in service, reducing this consequent limitation to service life.

Many hydrocarbonaceous liquids, most notably lubricants such as engine lubricants, are formulated to control the increase in acidity which oxidation processes cause, due to the formation of acid species in the liquid, and subsequent acidic corrosion or wear. Consequently, it is a further advantage for such liquids to control the build-up of acid species over service life. Deployment of the ionic liquid defined in this invention provides the further advantage of better control of acid build-up in the liquid, offering the formulator this additional benefit in the preparation of improved service liquids.

The ionic liquid defined in this invention thus provides advantages over conventional anti-oxidants and other ionic liquids previously contemplated in the art for use as additives in hydrocarbonaceous liquids, and offers an improved range of properties that enhance service liquid performance and service life.

U.S. Pat. No. 8,278,253 concerns enhancements in oxidation resistance of lubricating oils by the addition thereto of an additive amount of an ionic liquid. The description of the invention and Example 1 make clear that its method focusses on reducing hydroperoxide-induced oxidation, not the nitrogen-dioxide initiated degradation addressed by the present invention. A great variety of cations and anions are separately listed as possible constituents of the ionic liquid, of which the preferred anions and all anions in the examples are fluorine-containing, non-aromatic structures, the majority of which additionally comprise boron. This document does not disclose the defined cation-anion combination required for the ionic liquid of the present invention and fails to teach its advantages for inhibiting nitration of fresh, un-aged oils by nitrogen dioxide and for improving other relevant properties.

WO-A-2008/075016 concerns an ionic liquid additive for non-aqueous lubricating oil compositions. The ionic liquid additive is directed towards reducing wear and/or modifying friction properties, and defined as a non-halide, non-aromatic ionic liquid, wherein the anion A—comprises at least one oxygen atom and has an ionic head group attached to at least one alkyl or alicyclic hydrocarbyl group. This document also fails to disclose the defined cation-aromatic anion combination required for the ionic liquid of the present invention, and fails to teach its advantages for inhibiting nitration of fresh, un-aged oils by nitrogen dioxide and for improving other relevant properties.

WO-A-2013/158473 concerns lubricant compositions comprising ionic liquids and methods of using such compositions, targeted at minimising deposit and sludge formation in internal combustion engines. The worked examples target high temperature deposit formation that takes place after pre-test aging of the lubricating oil, in which fresh oil is blended with a substantial quantity of used lubricant, as well as being sparged with a dry air/nitrogen dioxide mixture, followed by a deposit-generating step on a metal surface heated to at least 200° C., and optimally to 320° C., whilst being exposed to simulated exhaust gases. The ionic liquid comprises a list of nitrogen-containing cations and an anion represented by the structure YCOO(—) wherein Y is alkyl or aromatic, preferably an alkyl or alkoxyl functional group having from 1 to 50 carbon atoms, or a benzene group, or an alkylated benzene group wherein said alkyl group(s) have 1 to 10 carbon atoms. This document fails to disclose the defined cation-anion combination of the ionic liquid deployed in the present invention, and fails to teach its advantage of inhibiting nitration of fresh, un-aged oils by nitrogen dioxide at bulk liquid temperatures below 200° C., and for improving other relevant properties.

US-A-2010/0187481 concerns the use of ionic liquids for improving the lubricating effect of synthetic, mineral or native oils. The invention discloses that the resulting lubricant composition is protected from thermal and oxidative attack. The ionic liquid is said to be superior to phenol-based or amine-based antioxidants as thermal and oxidative stabilisers, due to their solubility in organic systems or extremely low vapour pressure. The preferred anions of the ionic liquid are highly fluorinated for high thermal stability, such as bis(trifluoromethylsulfonyl)imide, and no mention or insight into the control of nitrogen-dioxide initiated degradation is provided.

The applicant has now found that deploying additive quantities of an ionic liquid composed of defined cations and boron- and halogen-free, multi-functional aromatic anions serves to inhibit the nitration of hydrocarbonaceous liquid due to nitrogen dioxide contamination at elevated temperature, and provides a method of limiting the chemical degradation of hydrocarbonaceous liquids even when fresh and un-aged by service. This method enables longer life from service liquids experiencing such contamination and provides additional advantages over the prior art as detailed herein.

SUMMARY OF THE INVENTION

In a first aspect, the present invention provides a method of limiting the chemical degradation of a hydrocarbonaceous liquid in service at bulk liquid temperatures of between 60 and 180° C., the degradation being initiated by nitration of the liquid resulting from contamination with nitrogen dioxide in service, comprising:

preparing, or obtaining a freshly prepared, hydrocarbonaceous liquid suitable for service at bulk liquid temperatures of between 60 and 180° C. and being free of aged components and nitrogen dioxide contamination;

adding to said hydrocarbonaceous liquid, prior to service at bulk liquid temperatures of between 60 and 180° C., an ionic liquid composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring, and this conjugated system bearing the anionic charge;

wherein the ionic liquid is added in an amount effective to thereafter inhibit the nitration of the hydrocarbonaceous liquid in service at bulk liquid temperatures of between 60 and 180° C., in the presence of nitrogen dioxide contamination; and putting said hydrocarbonaceous liquid into service, wherein the ionic liquid thereby limits the resulting chemical degradation of the liquid.

In a second aspect, the present invention provides the use of an ionic liquid as an additive to limit the chemical degradation of a hydrocarbonaceous liquid in service at bulk liquid temperatures of between 60 and 180° C., the degradation being initiated by nitration of the hydrocarbonaceous liquid resulting from contamination with nitrogen dioxide in service, the ionic liquid being composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring and this conjugated system bearing the anionic charge;

wherein the ionic liquid is added to a hydrocarbonaceous liquid free of aged components and nitrogen dioxide contamination prior to service, and wherein the ionic liquid thereafter inhibits the nitration of the hydrocarbonaceous liquid in service at bulk liquid temperatures of between 60 and 180° C. in the presence of nitrogen dioxide contamination.

In a third aspect, the present invention provides the nitration-resistant hydrocarbonaceous liquid obtained or obtainable by the method or use of any preceding claim.

In a fourth aspect, the present invention provides an additive concentrate composition for a hydrocarbonaceous liquid, comprising an ionic liquid composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring and this conjugated system bearing the anionic charge;

the concentrate further comprising a carrier liquid and, optionally, further additives. Preferred embodiments of these various aspects of the invention are described hereafter.

BRIEF DESCRIPTION OF THE DRAWINGS

This specification also makes reference to the following FIGURES, wherein:

FIG. 1 reports the gravimetric measurement of nitrogen dioxide uptake by various ionic liquids, as detailed in Example 1 hereinafter;

FIG. 2 reports the nitration peak heights in lubricating oil compositions containing ionic liquids during the T13 engine tests detailed in Example 4 hereinafter;

FIG. 3 reports the oxidation peak heights in lubricating oil compositions containing ionic liquids during the T13 engine tests detailed in Example 4 hereinafter; and FIG. 4 reports the kinematic viscosity increases in lubricating oil compositions containing ionic liquids during the T13 engine tests detailed in Example 4 hereinafter.

DETAILED DESCRIPTION OF THE INVENTION

It will be understood that various components used, essential as well as optional and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention. Accordingly, preferred and more preferred features of one aspect of the present invention may be independently combined with other preferred and/or more preferred features of the same aspect or different aspects of the present invention.

The importance of nitrogen dioxide-initiated degradation in fresh lubricant at elevated temperature has recently been reported by the applicant in the Paper cited as Coultas, D. R. "*The Role of NOx in Engine Lubricant Oxidation*" *SAE Technical Paper* 2020-0101427, 2020. *doi:* 10.4271/2020-01-1427. This paper notes in its introduction that "The principal mechanism by which NOx degrades the lubricant is through its involvement in free-radical nitro-oxidation reactions." The equations which follow show that nitrogen dioxide initiates the process via abstraction of a proton from liquid hydrocarbon species, setting in motion a sequence of reactions involving other species and leading to chemical degradation of the hydrocarbonaceous liquid. Nitrogen dioxide also features prominently further down this degradation pathway, by reacting with RO.radicals to form hydrocarbonaceous nitrate esters of the formula $RONO_2$. These accumulate in the lubricant, forming a reservoir of nitrate esters. At higher operating temperatures, these nitrate esters increasingly dissociate to release the captured RO.radicals, leading to the characteristic nitrate ester "volcano curve" pictured in FIG. 14 of this Paper. This rapid dissociation of nitrate esters into free radicals accelerates the chemical breakdown of the hydrocarbonaceous species in the liquid. This plurality of reactions involving nitrogen dioxide, including both initial proton abstraction and the dissociation of subsequently-formed nitrate esters, is herein referred to as "nitration" of the hydrocarbonaceous liquid.

The initiation of this nitration reaction pathway through proton abstraction by nitrogen dioxide, and the formation and dissociation of a reservoir of nitrate esters in the further action of nitrogen dioxide, have been determined by the applicant to be a function of elevated bulk liquid temperature. The initiation of the nitration reaction sequence is underway at 60° C. and grows at higher temperatures of 80° C. and above. The formation of nitrate ester builds significantly in the range of 110 to 180° C., and from 130° C. the dissociation rate of nitrate esters increases. In the temperature range of 110 to 160° C., the production and dissociation of nitrate ester is most pronounced and leads to more chemical degradation of the hydrocarbonaceous liquid. The trend to higher bulk liquid (sump) temperatures in modern engine lubricants (to temperatures of 130° C. and higher) thus increases the practical consequences of nitrogen dioxide contamination and renders the lubricants of these engines more susceptible to this form of degradation.

Without being bound to a particular theory, the applicant believes from technical investigations that the ionic liquid deployed in this invention has a particularly advantageous affinity for nitrogen dioxide which leads to its deactivation when present as a contaminant in hydrocarbonaceous liquids. Consequently, the nitrogen dioxide is inhibited from reacting with hydrocarbonaceous liquid species and initiating degradation via proton abstraction to begin the nitration reaction pathway. The nitrogen dioxide is further inhibited from reacting to form the nitrate esters that produces the volcano curve at higher temperatures and its eruption of radicals that leads to further degradation.

In particular, as detailed herein, the applicant has demonstrated the affinity of the ionic liquid deployed in this invention for nitrogen dioxide and shown it to be superior to other ionic liquids from the prior art. The applicant has also demonstrated the correspondingly improved ability of this invention to inhibit nitration of hydrocarbonaceous liquids under service conditions subject to elevated temperatures, and to inhibit the growth in bulk liquid acidity over time.

The related benefits in service conditions for the ionic liquid deployed in the present invention are demonstrated in the worked examples later in this specification.

The Ionic Liquid Deployed in all Aspects of the Invention

An ionic liquid is conventionally understood as an ionic compound, composed of one or more cation-anion pairs, which exists in liquid physical form at industrially useful temperatures. All aspects of the present invention deploy a defined ionic liquid composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring, and this conjugated system bearing the anionic charge.

Organic Cations

The one or more cations (i) carry the cationic (positive) charge and comprise one or multiple hydrocarbyl substituents providing organophilic character to the ionic liquid, enabling it to mix readily with hydrocarbonaceous bulk liquid.

In this specification the term "hydrocarbyl substituents" refer to groups which contain hydrogen and carbon atoms and are each bonded to the remainder of the compound directly via a carbon atom. The group may contain one or more atoms other than carbon and hydrogen (i.e., heteroatoms) provided they do not affect the essentially hydrocarbyl nature of the group, namely oxygen, nitrogen and sulfur atoms; such groups include amino, alkoxyl, mercapto, alkylmercapto, nitro, nitroso, and sulfoxy. Preferably, however, the hydrocarbyl group consists essentially of, and more preferably consists of, hydrogen and carbon atoms unless specified otherwise. Preferably, the hydrocarbyl group is or comprises an aliphatic hydrocarbyl group. The term "hydrocarbyl" encompasses the term "alkyl" as conventionally used herein. Preferably, the term "alkyl" means a radical of carbon and hydrogen (such as a $C_1$ to $C_{30}$, such as a $C_4$ to $C_{20}$ group). Alkyl groups in a compound are typically bonded to the compound directly via a carbon atom. Unless otherwise specified, alkyl groups may be linear (i.e., unbranched) or branched, be cyclic, acyclic or part cyclic/acyclic. The alkyl group may comprise a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl. Substituted alkyl groups are alkyl groups where a hydrogen or carbon has been replaced with a heteroatom (i.e., not H or C) or heteroatom containing group. The term "substituted' generally means that a hydrogen has been replaced with a carbon or heteroatom containing group.

In a first embodiment, one or more of the cations (i) of the ionic liquid may contain nitrogen. In this embodiment it is preferred that each cation (i) is a hydrocarbyl-substituted ammonium cation, or a hydrocarbyl-substituted alicyclic or aromatic ring system incorporating nitrogen and bearing the cationic charge.

In this first embodiment of the cation, it is preferred that each cation (i) is a hydrocarbyl-substituted ammonium cation, preferably a tetra-hydrocarbyl substituted ammonium cation. In this embodiment it is preferred that the hydrocarbyl groups are alkyl groups. The alkyl groups suitable as substituents for such ammonium cations include those straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such cations include butyl, hexyl, octyl, decyl, dodecyl, tetradecyl, hexadecyl, and octadecyl groups, and especially where n-alkyl groups. In embodiments, at least one of the alkyl substituents contains at least 10 carbon atoms and is selected from the above examples. Some of the alkyl substituents may be lower in carbon number, such as methyl groups. The ammonium cations may be substituted with 1, 2, 3 and or 4 hydrocarbyl groups, such as 1, 2, 3 or 4 alkyl groups (such as 1, 2, 3 or 4 linear alkyl groups). In embodiments, the 2, 3 or 4 alkyl groups are the same alkyl. Preferably the ammonium cation is substituted with 4 alkyl groups, preferably the same alkyl group. Most preferably in this embodiment, each cation (i) is a tetrabutyl ammonium cation, i.e., a cation carrying four butyl groups as substituents, these substituents preferably being linear groups. Such a cation is sometimes known in the industry by the shorthand term 'N4444' wherein the numbers relate the carbon numbers (4,4,4,4) of the four butyl groups respectively. Other most preferred cation examples are tetraoctyl ammonium (N8888)), trihexyltetradecyl ammonium ((N66614), and trimethyletradecyl (N11114) or trimethylhexadecyl (11116) ammonium.

Alternately the cation is a hydrocarbyl-substituted alicyclic or aromatic ring system incorporating nitrogen and bearing the cationic charge. Such nitrogen containing cations may be substituted with 1, 2, 3, 4 or more hydrocarbyl groups, such as 1, 2, 3 or 4 alkyl groups (such as 1, 2, 3 or 4 linear alkyl groups). In embodiments, the alkyl groups are the same alkyl. The alkyls may be one or more straight- or branched-chain alkyl groups containing 1 to 30, 6 to 28 carbon atoms, preferably 6 to 28 carbon atoms, more preferably 6 to 14 carbon atoms. Particularly suitable alkyl substituents for such cations include butyl, hexyl, octyl, decyl, dodecyl, tetradecyl, hexadecyl, and octadecyl groups, and especially where n-alkyl groups.

However, in a second, more preferred embodiment of the cation, each cation (i) of the ionic liquid is nitrogen-free. The ionic liquids of this embodiment have been found to be more advantageous in the present invention. They also provide a reduced contribution to nitrogen dioxide emissions when consumed, for example where the hydrocarbonaceous liquid is itself subject to combustion, such as where lubricating oil is consumed in an engine.

It is further preferred in this second embodiment that each cation (i) of the ionic liquid consists of a tetra-hydrocarbyl substituted central atom or ring system bearing the cationic charge. The hydrocarbyl groups may be the same or different and may be linear, branched, or cyclic. The hydrocarbyl groups are typically alkyl groups (such as linear or branched alkyl groups). In embodiments, the alkyl groups are the same alkyl, such as straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such cations include butyl, hexyl, octyl, decyl, dodecyl, tetradecyl, hexadecyl, and octadecyl groups, and especially where n-alkyl groups.

Most preferably, each cation (i) of the ionic liquid is a phosphorus-containing cation.

In this embodiment, it is preferred that each cation (i) is an alkyl substituted phosphonium cation, ideally a tetra-alkyl substituted phosphonium cation. The alkyl groups suitable as substituents for such phosphonium cations include those straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such phosphonium cations include hexyl, octyl, decyl, dodecyl, tetradecyl, hexadecyl, octadecyl and dodecyl groups, and especially where n-alkyl groups. In embodiments, at least one of the alkyl substituents contains at least 10 carbon atoms and is selected from the above examples. Some of the alkyl substituents may be lower in carbon number, such as methyl groups. The phosphonium cations may be substituted with 1, 2, 3 and or 4 hydrocarbyl groups, such as 1, 2, 3 or 4 alkyl groups (such as 1, 2, 3 or 4 linear alkyl groups). In embodiments, the 2, 3 or 4 alkyl groups are the same alkyl. Preferably the ammonium cation is substituted with 4 alkyl groups, preferably 1, 2, 3 or 4 are the same alkyl group. Alternately, at least one alkyl group is a $C_{10}$ to $C_{20}$ alkyl and 1, 2 or 3 alkyl groups are also present and are different from the $C_{10}$ to $C_{20}$ alkyl group. Alternately, at least one alkyl group is a $C_{10}$ to $C_{20}$ alkyl (such as $C_{12}$ to $C_{16}$, such as $C_{14}$ and 1, 2 or 3 alkyl groups are also present, are the same alkyl group, and are different from the $C_{10}$ to $C_{20}$ alkyl group. In embodiments the 1, 2, 3 and 4 hydrocarbyl groups are all $C_6$ or greater alkyl groups.

Most preferably, each cation (i) is a trihexyltetradecyl phosphonium cation, i.e., a cation carrying three hexyl and one tetradecyl groups as substituents, these substituents preferably being linear alkyl groups. Such an anion is sometimes known in the industry by the shorthand term 'P66614' wherein the numbers relate the carbon numbers (6,6,6,14) of the three hexyl and one tetradecyl groups respectively.

Alternately, the cation may comprise mixture of one or more hydrocarbyl substituted phosphonium cations and one or more hydrocarbyl-substituted ammonium cations, such as one or more tetra-hydrocarbyl (such as alkyl) substituted ammonium and one or more tetra-hydrocarbyl (such as alkyl) substituted phosphonium cations as described above. In embodiments, the alkyl groups are the same alkyl, such as straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such cations include butyl, hexyl, octyl, decyl, dodecyl, tetradecyl, hexadecyl, octadecyl, and dodecyl groups, and especially where n-alkyl groups.

The one or more anions (ii) comprise an aromatic ring bearing at least two substituent functional groups containing heteroatoms (typically at ortho, meta or para positions to each other), these functional groups being conjugated with the aromatic ring, and this conjugated system bearing the anionic (negative) charge. In this specification, the term "conjugated" is used in its conventional chemical sense to mean these substituent functional groups are bonded directly to the aromatic ring, wherein one or more p orbitals of one or more atoms comprised within each of these functional groups link to the p orbitals of the adjacent aromatic ring to participate in the delocalised electron cloud of the aromatic ring. It is believed that anions of this configuration have a particular affinity for nitrogen dioxide, and are able to bind to it in such a way that its reactivity towards hydrocarbonaceous compounds is significantly reduced.

The aromatic ring is composed of carbon and optionally one or more heteroatoms, such as phosphorus, nitrogen or oxygen, preferably N or O. However, it is preferred that each anion (ii) of the ionic liquid is nitrogen-free or sulfur-free or both. Such ionic liquids have been found to be more advantageous in the present invention and cannot make a contribution to nitrogen and/or sulfur oxide(s) formation in environments where a proportion of the ionic liquid will be consumed by combustion, for example in engine lubricant environments.

In a first embodiment of the anion, the aromatic ring of each anion (ii) bears two conjugated substituent functional groups containing heteroatoms, this system bearing the anionic (negative) charge. (The two conjugated substituent functional groups containing heteroatoms may be present at ortho, meta or para positions to each other.) This feature of an aromatic ring bearing two conjugated substituent functional groups containing heteroatoms, is preferably provided by the aromatic ring of each anion (ii) of the ionic liquid bearing a carboxylate group and a further heteroatom-containing functional group bonded directly to the aromatic ring, this system bearing the anionic charge. It is more preferred that the heteroatom(s) in both these functional groups consist of oxygen atoms. These functional groups are more preferably positioned on adjacent ring carbon atoms in 'ortho' configuration to each other on the aromatic ring.

In this embodiment of the anion, it is highly preferred that each anion (ii) is a disubstituted benzene ring bearing a carboxylate group and a second hetero-atom-containing functional group containing only oxygen as the heteroatom, these two groups preferably being positioned in 'ortho' configuration to each other on the aromatic ring. It is preferred that the second functional group is a hydroxyl group, giving rise to a hydroxybenzoate anion (ii). Most preferably the one or more anions (ii) of the ionic liquid are one or more salicylate anions, i.e., anions formed from the deprotonation of salicylic acid.

In a second, more preferred embodiment of the anion, the aromatic ring of each anion (ii) of the ionic liquid bears the substituent groups of the first embodiment of the anion, preferably those of the preceding two paragraphs, and additionally bears one or more hydrocarbyl substituents. These hydrocarbyl substituents provide additional organophilic character to the ionic liquid, enabling it to mix more readily with hydrocarbonaceous bulk liquid.

The hydrocarbyl substituent(s) of this second embodiment of the anion are as previously defined. The hydrocarbyl groups may be the same or different and may be linear, branched, or cyclic. The hydrocarbyl groups are typically alkyl groups (such as linear or branched alkyl groups). In embodiments, the alkyl groups are the same alkyl, such as straight- or branched-chain alkyl groups containing 1 to 28 carbon atoms, such as 4 to 28 carbon atoms, preferably 6 to 28 carbon atoms, more preferably 6 to 14 carbon atoms. Preferably, the hydrocarbyl substituent(s) are alkyl substituents. Suitable alkyl groups include those straight- or branched-chain alkyl groups containing 6 or more carbon atoms, preferably 6 to 28 carbon atoms, more preferably 6 to 14 carbon atoms. Particularly suitable alkyl substituents include hexyl, octyl, decyl, dodecyl, tetradecyl, hexadecyl, and octadecyl groups, and especially where n-alkyl groups.

The aromatic ring of this second embodiment of anion (ii) may bear a single alkyl substituent or multiple alkyl substituents. The consequent ionic liquid may be composed of a mixture of anions (ii) differing in their number and/or position of alkyl substituents, which are preferably selected from straight- or branched-chain alkyl groups containing 6 or more carbon atoms, preferably 6 to 28 carbon atoms, alternately 8 to 18 carbon atoms, preferably 6 to 14 carbon atoms (such as hexyl, octyl, decyl, dodecyl, tetradecyl, hexadecyl and octadecyl groups, and especially n-alkyl groups), including the above-specified alkyl substituents. Preferably at least one of the alkyl substituents contains at least 10 carbon atoms (such as at least 11, 12, 13, 14, 16, 16, 17, 18, or 19 to 20, 21, 22, 23, 24, 25, 26, 27 or 28 carbon atoms) and is selected from the above examples (such as hexyl, octyl, decyl, dodecyl, tetradecyl, hexadecyl and octadecyl groups, and especially n-alkyl groups). More preferably, the aromatic ring of each anion (ii) of the ionic liquid bears one or more straight- or branched-chain alkyl substituents having more than 10 carbon atoms (such as at least 11, 12, 13, 14, 16, 16, 17, 18, or 19 to 20, 21, 22, 23, 24, 25, 26, or 27 or 28 carbon atoms (such as decyl, dodecyl, tetradecyl, hexadecyl and octadecyl groups, and especially n-alkyl groups).

In the second embodiment of the anion, one or more anions (ii) are hydrocarbyl-substituted hydroxybenzoates of the structure:

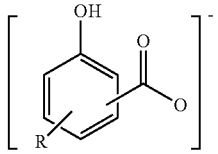

wherein R is a linear or branched hydrocarbyl group, and more preferably an alkyl group as defined above, including straight- or branched-chain alkyl groups, such as straight- or branched-chain alkyl groups containing 6 or more carbon atoms, preferably 6 to 28 carbon atoms, alternately 8 to 18 carbon atoms, more preferably 6 to 14 carbon atoms (such as hexyl, octyl, decyl, dodecyl, tetradecyl, and hexadecyl groups), and especially where n-alkyl groups. There may be more than one R group attached to the benzene ring, such as 1, 2, 3, or 4 R groups. The carboxylate group and hydroxyl group are conjugated to the aromatic ring, and this system bears the negative (anionic) charge. The carboxylate group can be in the ortho, meta or para position with respect to the hydroxyl group; the ortho position is preferred. The R group can be in the ortho, meta or para position with respect to the hydroxyl group.

In the second embodiment of the anion, one or more anions (ii) of the ionic liquid are most preferably one or more alkyl-substituted salicylate anions, wherein the alkyl substituent(s) of each anion are independently selected from alkyl groups containing from 12 to 24 carbon atoms, such as from 12 to 20 carbon atoms, such as from 12 to 18 carbon atoms, such as 14 to 18 carbon atoms; and more preferably from dodecyl, tetradecyl, hexadecyl and octadecyl groups.

Such hydroxybenzoate and salicylate anions are typically prepared via the carboxylation, by the Kolbe-Schmitt process, of phenoxides, and in that case, will generally be obtained (normally in a diluent) in admixture with uncarboxylated phenol.

In both the first and second embodiments of the anion (ii), it is preferred that each anion (ii) is nitrogen-free.

The ionic liquid is preferably composed of one or more cations (i) and one or more anions (ii) drawn from the above embodiments. The ionic liquid may preferably be composed of the first embodiment of the cation (i) in combination with either the first or second embodiment of the anion (ii), or a mixture thereof. More preferably, the ionic liquid is composed of the second embodiment of the cation (i) in combination with either the first or second embodiment of the anion (ii), or a mixture thereof.

The ionic liquid may preferably be composed of the first and or second embodiment of the cation (i) in combination with either the first or second embodiment of the anion (ii), or a mixture thereof.

Most preferably, the ionic liquid is composed of the second embodiment of the cation (i) in combination with the second embodiment of the anion (ii). Such ionic liquids provide particular advantages when deployed according to the various aspects of the invention. It is most preferred in this combination that each cation (i) and anion (ii) is nitrogen-free.

In particular, ionic liquids are preferred in which each cation (i) is nitrogen-free and consists of a tetra-hydrocarbyl substituted central atom or ring system bearing the cationic charge, and each anion (ii) bears two substituent functional groups containing heteroatoms, as hereinbefore described. The preferred examples described hereinbefore for each such cation (i) and anion (ii) are particularly useful in combination. More preferably, the aromatic ring of each anion (ii) of such an ionic liquid bears a carboxylate group and a further heteroatom-containing functional group. It is more preferred that the heteroatom(s) in both these functional groups consist of oxygen atoms. These functional groups are most preferably positioned on adjacent ring carbon atoms in 'ortho' configuration to each other on the aromatic ring.

In all the preferred ionic liquids, and especially the ionic liquids of the three preceding paragraphs, each cation (i) is most preferably an alkyl substituted phosphonium cation, ideally a tetra-alkyl substituted phosphonium cation as hereinbefore described. The trihexyltetradecyl-phosphonium cation (P66614 cation) is most preferred.

The ionic liquid of all aspects of the invention may be prepared by synthetic routes known in the art, chosen by the skilled person according to conventional synthesis criteria with regard to suitability for the desired cation-anion combination.

Thus, in ionic liquids comprising the first embodiment of the cation (i), this cation can for example be formed by alkylation or arylation, and preferably alkylation, of the corresponding amine or nitrogen-containing ring compound using a nucleophilic substitution reaction with an alkylating or arylating agent that may for example by an alkyl or arylhalide, preferably an alkyl halide. The resulting cation-halide complex may thereafter be mixed with the desired stoichiometric amount of a metal salt of the desired anion (ii), typically in a dry organic solvent selected to solubilise the desired ionic liquid but precipitate the metal halide formed after anion exchange. An anion exchange resin may be adopted to promote the exchange reaction.

In ionic liquids comprising the second embodiment of the cation (i), this liquid can likewise be formed from the cation-halide complex of the desire cation (ii), such as the preferred phosphonium cation, which is then subjected to anion exchange in a suitable solvent with the precursor of the desired anion. Again an anion exchange resin may be employed to promote the exchange. The solvent is then stripped and the ionic liquid recovered.

Examples of synthetic methods for ionic liquids are provided in US-A-2008/0251759 and in the worked examples detailed later in this specification. In addition, the individual cations and anions or precursors thereto are available as items of chemical commerce.

Without being bound to a particular theory, the applicant believes that the particular advantages of the ionic liquid defined in this invention in deactivating the degradative effects of nitrogen dioxide arises from the ionic liquid's composition and elucidated mechanism of action, with both anion and cation combining to play advantageous roles.

Firstly, the anion (ii) in the ionic liquid ion-pair is particularly capable of interacting with nitrogen dioxide molecules, effectively removing them from reactive circulation within the hydrocarbonaceous liquid. Consequently, the initial deprotonation of hydrocarbonaceous components in the bulk liquid is inhibited, and the nitration reaction sequence and formation of nitrate esters is likewise inhibited, resulting in a slower degradation of the bulk liquid over time.

Secondly, without being bound by theory, it is postulated that nitric acid formed in situ from the oxidation of some bound nitrogen dioxide is captured by the associated cation of the ionic liquid. This nitric acid loses its acidic proton to the negatively-charged anion-nitrogen dioxide complex, resulting in the formation of an ion-pair comprising the ionic liquid cation and nitrate anion, and a further complex between the protonated anion and remaining bound nitrogen dioxide. This sequence effectively also locks away the nitric acid from reactive circulation within the hydrocarbonaceous liquid. As a result, the build-up of acid over time in the hydrocarbonaceous liquid is also slower, and the ionic liquid helps to contain acid-mediated oxidation and acidic attack of the hydrocarbonaceous liquid and the underlying hardware.

In this way, the cation and anion of the ionic liquid act in combination to inhibit the degradative consequences of nitrogen dioxide contamination of the hydrocarbonaceous liquid and prolong service life.

The Method of the First Aspect of the Invention

The first aspect of the invention deploys the above ionic liquid in a method of limiting the chemical degradation of a hydrocarbonaceous liquid in service at bulk liquid temperatures of 60° C. or more, such as 100° C. or more, such as between 60 and 180° C. (such as from 60 to 160° C., such as 110 to 160° C., such as 130 to 160° C.), the degradation being initiated by nitration of the liquid resulting from contamination with nitrogen dioxide in service. The method comprises the steps of:

preparing, or obtaining a freshly-prepared, hydrocarbonaceous liquid suitable for service at bulk liquid temperatures of 60° C. or more, such as 100° C. or more, such as between 60 and 180° C. (such as from 60 to 160° C., such as 110 to 160° C., such as 130 to 160° C.) and being free of aged components and nitrogen dioxide contamination (or substantially free, e.g., less than 5 ppm, of aged components and less than 10 ppm, of nitrogen dioxide contamination);

adding the above defined ionic liquid to said hydrocarbonaceous liquid, prior to service at bulk liquid temperatures of 60° C. or more, such as 100° C. or more, such as between 60 and 180° C. (such as from 60 to 160° C., such as 110 to 160° C., such as 130 to 160° C.), wherein the ionic liquid is added in an amount effective to thereafter inhibit the nitration of the hydrocarbonaceous liquid in service at bulk liquid temperatures of 60° C. or more, such as 100° C. or more, such as between 60 to 180° C. (such as from 60 to 160° C., such as 110 to 160° C., such as 130 to 160° C.), in the presence of nitrogen dioxide contamination; and putting said hydrocarbonaceous liquid into service, wherein the ionic liquid thereby limits the resulting chemical degradation of the liquid.

In this method, the effectiveness of the ionic liquid in inhibiting the nitration reactions initiated by the nitrogen dioxide on hydrocarbonaceous compounds at elevated temperatures leads to the slower onset of degradation in the bulk liquid by this chemical pathway, prolonging its service life. The ionic liquid firstly acts through inhibiting the proton abstraction by nitrogen dioxide which initiates nitration of the bulk liquid, slowing the initial formation of free radicals which feeds other chemical reactions further along the pathway and delaying the onset of significant degradation. The ionic liquid further acts later in the pathway by inhibiting the formation of hydrocarbonaceous nitrate esters from the reaction of nitrogen dioxide with subsequent RO.radicals, resulting in a smaller accumulation of these reactive compounds within the bulk liquid. As a result, the bulk liquid is exposed to lower concentrations of released RO.radicals at elevated temperatures, especially those service temperatures rising (continuously or periodically) above 110° C., where the rate of dissociation of these nitrate esters greatly increases and results in escalating, more severe degradation of the bulk liquid.

The amount of ionic liquid effective to inhibit nitration in the method of the invention can be arrived at by routine testing under conditions reproducing or simulating nitrogen dioxide contamination at the elevated service temperatures experienced in the system in question.

In a preferred aspect of the method, the chemical degradation inhibited by the ionic liquid is that resulting from the decomposition of hydrocarbonaceous nitrate esters formed in service by the nitration of the hydrocarbonaceous liquid by nitrogen dioxide at bulk liquid temperatures of between 60 and 180, such as from 60 to 180° C. (such as 60 to 160° C., such as 110 to 160° C., such as 130 to 160° C.), wherein the ionic liquid is added in an amount determined to inhibit the formation of hydrocarbonaceous nitrate esters in that service. In this way, the accumulation of a reservoir of reactive hydrocarbonaceous nitrate esters at elevated service temperatures is directly inhibited, and degradation is better limited.

In a more preferred aspect of the method, the chemical degradation inhibited by the ionic liquid is that resulting from the decomposition of the hydrocarbonaceous nitrate esters due to the hydrocarbonaceous liquid being periodically or continuously subjected in service to bulk liquid temperatures of between 110 and 160° C., wherein the ionic liquid is added in an amount determined to inhibit the formation of hydrocarbonaceous nitrate esters in that service. In this way, the more rapid, severe degradation that occurs in service at higher elevated temperatures is directly inhibited.

In these embodiments of the invention, the level of nitrate ester formation in the bulk liquid can be determined spectroscopically by observing the growth in the infra-red peak height associated with nitrate ester over time in the bulk liquid under suitable test conditions. This spectroscopic approach allows the determination of the amount of ionic liquid required to inhibit the formation of nitrate esters in the bulk liquid. The inhibition of hydrocarbonaceous nitrate ester formation in service is determined by the observance of a lower nitrate ester peak height in the bulk liquid in the presence of the ionic liquid, as measured by infrared spectroscopy according to DIN 51 453 or ASTM D8048-20 (in the event of conflict between DIN 51 453 and ASTM D8048-20, DIN 51 453 shall control), under like conditions of service and nitrogen dioxide contamination. According to the DIN method, the height of a single infrared absorption frequency at 1630 cm-1 is measured above a straight-line baseline defined by the absorption at 1615 and 1645 cm-1. The higher the peak height, the more nitrate ester is present in the bulk liquid. Measurement of a series of samples taken over time also allows the change in peak height to be followed as the level of nitrate ester in the service liquid changes over time. According to the ASTM D8048-20 Standard test method, oxidation and nitration peak heights are measured by first subtracting the fresh oil infrared spectrum. The baseline is defined by absorption between 1950 cm-1 and 1850 cm-1 with highest peak in the range 1740 cm-1 to 1700 cm-1 used for oxidation and 1640 cm-1 to 1620 cm-1 for nitration.

Determining the amount of reduction or limitation of nitrate ester formation in a lubricating oil composition is determined by the observance of a lower (by at least 10%, such by at least 20%, such as by at least 30%, such as by at least 40%, such as by at least 50%, such as by 100%) nitrate ester peak height in the presence of the lubricating oil composition containing ionic liquid (as compared to the nitrate ester peak of the same lubricating oil composition where the ionic liquid is replaced with an ionic liquid having the same cation, but hexanoate as the anion in the same proportions), as measured by infrared spectroscopy according to DIN 51 453 or ASTM D8048-20, under like conditions of service and nitrogen dioxide contamination, provided that in the event of conflicting results between DIN 51 453 and ASTM D8048-20, DIN 51 453 shall control.

In normal circumstances, however, the amount of ionic liquid added to thereafter inhibit the nitration of the hydrocarbonaceous liquid in service at bulk liquid temperatures of 60° C. or more, such as 110° C. or more, such as between 60 and 180° C. (such as from 60 to 180° C., such as 60 to 160° C., such as 110 to 160° C., such as 130 to 160° C.), in the presence of nitrogen dioxide contamination, is in the range of 0.1 to 5.0% by weight, per weight of hydrocarbonaceous liquid; and preferably 0.5 to 4.0% by weight, per weight of hydrocarbonaceous liquid. More preferably, the ionic liquid is added in an amount in the range of 1.0 to 3.5% by weight, per weight of hydrocarbonaceous liquid; and most preferably in the range of 1.0 to 3.0% by weight, per weight of hydrocarbonaceous liquid.

The hydrocarbonaceous liquid deployed in the method of the invention is a liquid suitable for service at bulk liquid temperatures of 60° C. or more, such as 110° C. or more, such as between 60 and 180° C. (such as from 60 to 180° C., such as 60 to 160° C., such as 110 to 160° C., such as 130 to 160° C.) and being free of aged components and nitrogen dioxide contamination prior to service (or substantially free, e.g., less than 5 ppm, of aged components and less than 10 ppm, of nitrogen dioxide contamination). Such service liquids are used in a variety of applications, including industrial and automotive oils and power transmission fluids, such as engine lubricating oils.

In the method, the hydrocarbonaceous liquid is preferably a lubricating oil for a mechanical device. More preferably in the method, the hydrocarbonaceous liquid is a crankcase lubricating oil for an internal combustion engine, and is subjected in service to nitrogen dioxide contamination originating from exhaust gas, which gas becomes entrained in the lubricant via the effects of blow-by gas into the crankcase and direct contact on the engine cylinder walls. Most preferably, this crankcase lubricating oil is one periodically or continuously subjected to bulk liquid temperatures in the crankcase of between 110 and 160° C.

It is important to obtaining the benefits of the method that, prior to service, the hydrocarbonaceous liquid be initially free of nitrogen dioxide contamination and also be initially free of the aged liquid components that arise during service from oxidative or other chemical breakdown, in order not to seed the liquid with significant quantities of reactive chemical species that can offer an alternative or complementary degradative pathway to nitrogen-dioxide initiated nitration. Alternately, prior to service, the hydrocarbonaceous liquid may be initially substantially free of nitrogen dioxide contamination (10 ppm or less, such as 5 ppm or less, such as 0 ppm) and also substantially free of the aged liquid components (10 ppm or less, such as 5 ppm or less, such as 0 ppm) that arise during service from oxidative or other chemical breakdown (or substantially free, e.g., less than 0.0001-mass % of aged components and less than 10 ppm, of nitrogen dioxide contamination). Thus, preferably, the hydrocarbonaceous liquid should be freshly prepared and not have been in prior service; and prior to being placed into the service environment should not be pre-mixed or diluted with a proportion of aged liquid that has been in prior use or exposed to nitrogen dioxide contamination.

Alternately, prior to service, the hydrocarbonaceous liquid may be initially substantially free of nitrogen dioxide contamination (10 ppm or less, such as 5 ppm or less, such as 0 ppm) and also substantially free of the aged liquid components (10 ppm or less, such as 5 ppm or less, such as 0 ppm) that arise during service from oxidative or other chemical breakdown (or substantially free, e.g., less than 0.0001-mass % of aged components and less than 10 ppm, of nitrogen dioxide contamination).

It is also important that the ionic liquid is added prior to service and the resulting onset of elevated temperatures and nitrogen dioxide contamination, to maximise its nitration-inhibiting effect and not allow nitrogen dioxide concentration in the bulk liquid to build unhindered.

The hydrocarbonaceous liquid used as the bulk service liquid in the method may be derived from petroleum or synthetic sources, or from the processing of renewable materials, such as biomaterials.

Where the hydrocarbonaceous liquid is a petroleum oil, and especially a lubricating oil, such oils range in viscosity from light distillate mineral oils to heavy lubricating oils such as gasoline engine oils, mineral lubricating oils and heavy-duty diesel oils. Generally, the kinematic viscosity of the oil ranges from about 2 $mm^2$/sec (centistokes) to about 40 $mm^2$/sec, especially from about 3 $mm^2$/sec to about 20 $mm^2$/sec, most preferably from about 9 $mm^2$/sec to about 17 $mm^2$/sec, measured at 100° C. (ASTM D445-19a)?

Suitable oils, especially as lubricating oils, include natural oils such as animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful bulk oils.

Synthetic oils, and especially synthetic lubricating oils, include hydrocarbon oils and halo-substituted hydrocarbon oils retaining hydrocarbonaceous character, such as polymerized and copolymerized olefins (e.g., ethylene-propylene copolymers, polybutylene homo- and copolymers, polypropylene homo and copolymers, propylene-isobutylene copolymers, chlorinated polybutylenes, poly(l-hexenes), poly(l-octenes), poly-n-decenes (such as decene homopolymers or copolymers of decene and one or more of C8 to C20 alkenes, other than decene, such as octene, nonene, undecene, dodecene, tetradecene and the like); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof. Also useful are synthetic oils derived from a gas to liquid process from Fischer-Tropsch synthesized hydrocarbons, which are commonly referred to as gas to liquid, or "GTL" base oils.

Esters are useful as synthetic oils having hydrocarbonaceous character and include those made from C5 to C12 monocarboxylic acids and polyols and polyol esters such as neopentyl glycol, trimethylolpropane, pentaerythritol, dipentaerythritol and tripentaerythritol.

Where the hydrocarbonaceous liquid is a lubricating oil, it may comprise a Group I, Group II, Group III, Group IV or Group V base stock or blend of the aforementioned base stocks. Preferably, the lubricating oil is a Group II, Group III, Group IV or Group V base stock, or a mixture thereof, such as a mixture of a Group I base stock and one or more a Group II, Group III, Group IV or Group V base stock. Definitions for these base stocks and base oils are found in the American Petroleum Institute (API) publication Engine Oil Licensing and Certification System, ("ELOCS") Industry Services Department, Fourteenth Edition, December 1996, Addendum 1, December 1998.

The base stock, or base stock blend preferably has a saturate content of at least 65%, more preferably at least 75%, such as at least 85%. Preferably, the base stock or base stock blend is a Group III or higher base stock or mixture thereof, or a mixture of a Group II base stock and a Group III or higher base stock or mixture thereof. Most preferably, the base stock, or base stock blend, has a saturate content of greater than 90%. Preferably, the oil or oil blend will have a sulfur content of less than 1 mass %, preferably less than 0.6 mass %, most preferably less than 0.4 mass %, such as less than 0.3 mass % (as determined as indicated in API EOLCS). Group III base stock has been found to provide a wear credit relative to Group I base stock and therefore, in one preferred embodiment, at least 30 mass %, preferably at least 50 mass %, more preferably at least 80 mass % of the lubricating oil is Group III base stock.

Preferably the volatility of the lubricating oil or oil blend, as measured by the Noack test (ASTM D5800), is less than or equal to 30 mass %, such as less than about 25 mass %, preferably less than or equal to 20 mass %, more preferably less than or equal to 15 mass %, most preferably less than or equal 13 mass %.

Preferably, the viscosity index (VI) of the oil or oil blend is at least 85, preferably at least 100, most preferably from about 105 to 140 (ASTM D 2270).

In the method of the first aspect, the ionic liquid can be added to the hydrocarbonaceous liquid by physical mixing or blending techniques known in the art. It may be desirable, although not essential, to prepare one or more additive concentrates comprising the ionic liquid in a carrier liquid (being a diluent or solvent mutually compatible with both the ionic liquid and the hydrocarbonaceous liquid), to enable easier mixing or blending, whereby other additives can also be added simultaneously to the concentrate, and hence to the oil, to form the lubricating oil composition (such concentrates with additives sometimes being referred to as additive packages). The ionic liquid may be added to an additive concentrate prior to the concentrate being combined with a hydrocarbonaceous liquid or may be added to a combination of additive concentrate and hydrocarbonaceous liquid. The ionic liquid may be added to an additive package prior to the package being combined with a hydrocarbonaceous liquid or may be added to a combination of additive package and hydrocarbonaceous liquid.

Where an additive concentrate is used, it may contain from 5 to 25 mass %, preferably 5 to 22 mass %, typically 10 to 20 mass %, based upon the weight of the concentrate of the ionic liquid, the remainder of the concentrate being solvent or diluent.

Where an additive package is used, it may contain from 5 to 25 mass %, preferably 5 to 22 mass %, typically 10 to 20 mass %, based upon the weight of the concentrate of the ionic liquid, the remainder of the package being other additives (such as dispersant, detergent, etc.), solvent or diluent.

The advantageous nature of the method in limiting the chemical degradation due to nitration is demonstrated hereinafter in the worked examples of the invention.

The Use of the Second Aspect of the Invention

The second aspect of the invention provides the use of the ionic liquid hereinbefore described as an additive to limit the chemical degradation of a hydrocarbonaceous liquid in service at bulk liquid temperatures of 60° C. or more, or 110° C. or more, such as between 60 and 180° C. (such as from 60 to 180° C., such as 60 to 160° C., such as 110 to 160° C., such as 130 to 160° C.), the degradation being initiated by nitration of the hydrocarbonaceous liquid resulting from contamination with nitrogen dioxide in service, wherein the ionic liquid is added to a hydrocarbonaceous liquid free of aged components and nitrogen dioxide contamination prior to service, and wherein the ionic liquid thereafter inhibits the nitration of the hydrocarbonaceous liquid in service at bulk liquid temperatures of 60° C. or more, or 110° C. or more, such as between 60 and 180° C. (such as from 60 to 180° C., such as from 60 to 160° C., such as 110 to 160° C., such as 130 to 160° C.) in the presence of nitrogen dioxide contamination.

The second aspect of the invention uses the ionic liquid to inhibit the nitration of a hydrocarbonaceous liquid initiated by contamination with nitrogen dioxide in service at bulk liquid temperatures of 60° C. or more, or 110° C. or more, such as between 60 and 180° C. (such as from 60 to 180° C., such as from 60 to 160° C., such as 110 to 160° C., such as 130 to 160° C.). In the use, the ionic liquid acts as hereinbefore described, and thus serves to limit the chemical degradation of the bulk hydrocarbonaceous liquid resulting from nitrogen dioxide contamination.

The ionic liquids and hydrocarbonaceous liquids that are suitable and preferred in the use aspect of the invention are those already described in this specification. The amount of ionic liquid effective to inhibit nitration in the method of the invention can be arrived at by routine testing under conditions reproducing or simulating nitrogen dioxide contamination at the elevated service temperatures experienced in the system in question.

In a preferred aspect of the use, the chemical degradation inhibited by the ionic liquid is that resulting from the decomposition of hydrocarbonaceous nitrate esters formed in service by the nitration of the hydrocarbonaceous liquid by nitrogen dioxide at bulk liquid temperatures of 60° C. or more, or 110° C. or more, such as between 60 and 180° C. (such as from 60 to 180° C., such as 60 to 160° C., such as 110 to 160° C., such as 130 to 160° C.), and the ionic liquid inhibits the formation of hydrocarbonaceous nitrate esters in that service. In this way, the accumulation of a reservoir of reactive hydrocarbonaceous nitrate esters at elevated service temperatures is directly inhibited, and degradation is better limited.

In a more preferred aspect of the use, the chemical degradation inhibited by the ionic liquid is that resulting from the decomposition of the hydrocarbonaceous nitrate esters due to the hydrocarbonaceous liquid being periodically or continuously subjected in service to bulk liquid temperatures of 60° C. or more, or 110° C. or more, such as between 110 and 160° C. (such as 110 to 160° C., such as 130 to 160° C.), and the ionic liquid inhibits the formation of hydrocarbonaceous nitrate esters in that service. In this way, the more rapid, severe degradation that occurs in service at higher elevated temperatures is directly inhibited.

In these use embodiments of the invention, the level of nitrate ester formation in the bulk liquid can be determined spectroscopically by observing the growth in the infra-red peak height associated with nitrate ester over time in the bulk liquid under suitable test conditions. This spectroscopic approach allows the observation of the effect of ionic liquid to inhibit the formation of nitrate esters in the bulk liquid. The inhibition of hydrocarbonaceous nitrate ester formation in service is determined by the observance of a lower nitrate ester peak height in the bulk liquid in the presence of the ionic liquid, as measured by infrared spectroscopy according to DIN 51 453, under like conditions of service and nitrogen dioxide contamination. According to this DIN method, the height of a single infrared absorption frequency at 1630 cm-1 is measured above a straight-line baseline defined by the absorption at 1615 and 1645 cm-1. The higher the peak height, the more nitrate ester is present in the bulk liquid. Measurement of a series of samples taken over time also allows the change in peak height to be followed as the level of nitrate ester in the service liquid changes over time.

In normal circumstances, however, the amount of ionic liquid used to inhibit the nitration of the hydrocarbonaceous liquid in service at bulk liquid temperatures of 60° C. or more, or 110° C. or more, such as between 60 and 180° C. (such as from 60 to 180° C., such as 60 to 160° C., such as 110 to 160° C., such as 130 to 160° C.), in the presence of nitrogen dioxide contamination, is in the range of 0.1 to 5.0% by weight, per weight of hydrocarbonaceous liquid; and preferably 0.5 to 4.0% by weight, per weight of hydrocarbonaceous liquid. More preferably, the ionic liquid is used in an amount in the range of 1.0 to 3.5% by weight, per weight of hydrocarbonaceous liquid; and most preferably in the range of 1.0 to 3.0% by weight, per weight of hydrocarbonaceous liquid.

Most preferably, the method of the first aspect of the invention, and use of the second aspect of the invention, are directed to limiting the chemical degradation of hydrocarbonaceous liquids that are engine lubricating oils. These oils are exposed to nitrogen dioxide contamination in service, due to the presence of exhaust gas blow-by from the combustion chamber past the piston rings into the crankcase. Such oils, also termed crankcase oils, operate at bulk liquid temperatures wherein the nitration pathway to oil degradation is significant, especially when the oil is fresh and aged oil components have not appreciably formed by other mechanisms. Hotter-running engines are particularly susceptible to such degradation, especially those experiencing temperature regimes or cycles in the bulk crankcase oil of between 110 and 160° C., and in particular between 130 and 160° C. (such as from 110 to 160° C., and in particular from 130 to 160° C.).

The Liquid of the Third Aspect of the Invention

The third aspect of the invention is the nitration-resistant hydrocarbonaceous liquid obtained or obtainable by the method or use of any preceding claim. Such a liquid is formed from the ionic liquids and hydrocarbonaceous liquids described hereinbefore.

Preferably, the nitration-resistant hydrocarbonaceous liquid of the third aspect is an engine lubricating oil to which has been added the ionic liquid as hereinbefore described.

The Additive Concentrate of the Fourth Aspect of the Invention

The fourth aspect of the invention is an additive concentrate composition for a hydrocarbonaceous liquid, comprising the ionic liquid, a carrier liquid and, optionally, further additives.

Such an additive concentrate is hereinbefore described under the method of the first aspect.

The additive concentrate may comprise further additives as a convenient way of incorporating multiple additives simultaneously into the hydrocarbonaceous liquid. Such further additives can have various properties and purposes depending on the needs of the service liquid in question.

Where the hydrocarbonaceous liquid is a lubricating oil or power transmission oil, particularly an engine lubricating oil, a variety of further additives may be incorporated to enhance other characteristics of the oil, which may comprise one or more phosphorus-containing compounds; dispersants; metal detergents; anti-wear agents; friction modifiers, viscosity modifiers; antioxidants; and other co-additives, provided they are different from essential ionic liquids hereinbefore described. These are discussed in more detail below.

Suitable phosphorus-containing compounds include dihydrocarbyl dithiophosphate metal salts, which are frequently used as antiwear agents. The metal is preferably zinc, but may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with P2S5, and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil-soluble salts of dihydrocarbyl dithiophosphoric acids and may be represented by the following formula:

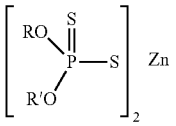

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups in this context are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be 5 or greater. The zinc dihydrocarbyl dithiophosphate (ZDDP) can therefore comprise zinc dialkyl dithiophosphates. Additive concentrates of the present invention for lubricants may have a phosphorus content of 100 to 1500 ppm P, such as 200 to 1200 ppm P, such as 600 to 900 ppm P, such as of no greater than about 0.08 mass % (800 ppm) as determined by ASTM D5185. Preferably, in the practice of the present invention, ZDDP is used in an amount close or equal to the maximum amount allowed, preferably in an amount that provides a phosphorus content within 100 ppm of the maximum allowable amount of phosphorus. Thus, resulting lubricating oil compositions preferably contain ZDDP or other zinc-phosphorus compounds, in an amount introducing from 0.01 to 0.08 mass % of phosphorus, such as from 0.04 to 0.08 mass % of phosphorus, preferably, from 0.05 to 0.08 mass % of phosphorus, based on the total mass of the lubricating oil composition.

A dispersant is an additive whose primary function is to hold oil-insoluble contaminations in suspension, thereby passivating them and reducing deposition on surfaces. For example, a dispersant maintains in suspension oil-insoluble substances that result from oxidation during use, thus preventing solids flocculation and precipitation or deposition on hardware parts.

Dispersants in this invention are preferably "ashless", being non-metallic organic materials that form substantially no ash on combustion, in contrast to metal-containing and hence ash-forming materials. They comprise a long hydrocarbon chain with a polar head, the polarity being derived from inclusion of preferably an oxygen, phosphorus or nitrogen atom. The hydrocarbon is an oleophilic group that confers oil-solubility, having, for example 40 to 500 carbon atoms, such as 60 to 250 carbon atoms. Thus, ashless dispersants may comprise an oil-soluble polymeric backbone. The hydrocarbon portion of the dispersant may have a number average molecular weight (Mn) of from 800 to 5,000 g/mol, such as from 900 to 3000 g/mol.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. Typically, a hydrocarbon polymeric material, such as polyisobutylene, is reacted with an acylating group (such as maleic acid or anhydride) to form a hydrocarbon-substituted succinic acid (succinate). A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025), fluorinated or oxylated. For example, boration may be accomplished by treating an acyl nitrogen-containing dispersant with a boron compound selected from boron oxide, boron halides, boron acids and esters of boron acids.

Preferably, the dispersant, if present, is a succinimide-dispersant derived from a polyisobutene of number average molecular weight in the range of 800 to 5000 g/mol, such as 1000 to 3000 g/mol, preferably 1500 to 2500 g/mol, and of moderate functionality. The succinimide is preferably derived from highly reactive polyisobutene.

Another example of dispersant type that may be used is a linked aromatic compound such as described in EP-A-2 090 642.

Combinations of borated and non-borated succinimide are useful herein.

Combinations of one or more (such as two or more) higher Mn succinimides (Mn of 1500 g/mol or more, such as 2000 g/mol or more) and one or more (such as two or more) lower Mn (Mn less than 1500 g/mol, such as less than 1200 g/mol) succinimides are useful herein, where the combinations may optionally contain one, two, three or more borated succinimides.

A detergent is an additive that reduces formation of deposits, for example high-temperature varnish and lacquer deposits; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a total base number "TBN" at 100% active mass (as may be measured by ASTM D2896) of from 0 to 150 mg KOH/g, such as 10 to 80 mg KOH/g. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g., carbonate) micelle. Such overbased detergents may have a total base number (TBN) at 100% active mass of more than 150 mg KOH/g, such as 200 mg KOH/g or greater, such as such as 250 mg KOH/g or greater and typically of from 200 to 800 mg KOH/g, 225 to 700 mg KOH/g, such as 250 to 650 mg KOH/g, or 300 to 600 mg KOH/g, such as 150 to 650 mg KOH/g, preferably from 200 to 500 or more.

Suitably, detergents that may be used include oil-soluble neutral and overbased sulfonates, phenates, sulfurised phenates, thiophosphonates, salicylates and naphthenates and other oil-soluble carboxylates of a metal, particularly alkali metal or alkaline earth metals, e.g., Na, K, Li, Ca and Mg. The most commonly used metals are Ca and Mg, which may both be present in detergents used particularly in lubricating compositions, and mixtures of Ca and/or Mg with Na. Detergents may be used in various combinations.

Preferably, the detergent additive(s) useful in the present invention comprises calcium and/or magnesium metal salts. The detergent may a calcium and or magnesium carboxylate (e.g., salicylates), sulfonate, or phenate detergent. More preferably, the detergents additives are selected from magnesium salicylate, calcium salicylate, magnesium sulfonate, calcium sulfonate, magnesium phenate, calcium phenate, and hybrid detergents comprising two, three, four or more of more of these detergents and/or combinations thereof.

The magnesium detergent provides the lubricating composition thereof with from 200-4000 ppm of magnesium atoms, suitably from 200-2000 ppm, from 300 to 1500 or from 450-1200 ppm of magnesium atoms (ASTM D5185).

Calcium detergent is typically present in amount sufficient to provide at least 500 ppm, preferably at least 750 more preferably at least 900 ppm atomic calcium to the lubricating oil composition (ASTM D5185). If present, any calcium detergent is suitably present in amount sufficient to provide no more than 4000 ppm, preferably no more than 3000, more preferably no more than 2000 ppm atomic calcium to the lubricating oil composition (ASTM D5185). If present, any calcium detergent is suitably present in amount sufficient to provide at from 500-4000 ppm, preferably from 750-3000 ppm more preferably from 900-2000 ppm atomic calcium to the lubricating oil composition (ASTM D5185).

The detergent composition may comprise (or consist of) a combination of one or more magnesium sulfonate detergents and one or more calcium salicylate detergents.

The combination of one or more magnesium sulfonate detergents and one or more calcium salicylate detergents provides the lubricating composition thereof with: 1) from 200-4000 ppm of magnesium atoms, suitably from 200-2000 ppm, from 300 to 1500 or from 450-1200 ppm of magnesium atoms (ASTM D5185), and 2) at least 500 ppm, preferably at least 750 more preferably at least 900 ppm of atomic calcium, such as from 500-4000 ppm, preferably from 750-3000 ppm, more preferably from 900-2000 ppm atomic calcium (ASTM D5185).

Additional additives may be incorporated into the additive concentrates of the invention to enable particular performance requirements to be met. Examples of such additives which may be included in lubricating oil compositions of the present invention are friction modifiers, viscosity modifiers, metal rust inhibitors, viscosity index improvers, corrosion inhibitors, oxidation inhibitors, anti-foaming agents, anti-wear agents and pour point depressants.

Friction modifiers (and, also in engine lubricants, fuel economy agents) that are compatible with the other ingredients of hydrocarbonaceous liquid may be included in the lubricating oil composition. Examples of such materials include glyceryl monoesters of higher fatty acids, for example, glyceryl mono-oleate; esters of long chain polycarboxylic acids with diols, for example, the butane diol ester of a dimerized unsaturated fatty acid; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, MoOCl4, MoO2Br2, Mo2O3Cl6, molybdenum trioxide or similar acidic molybdenum compounds.

Among the molybdenum compounds useful in the compositions of this invention are organo-molybdenum compounds of the formulae:

$Mo(R''OCS_2)_4$ and $Mo(R''SCS_2)_4$ wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful as further additives in this invention are trinuclear molybdenum compounds, especially those of the formula Mo3SkAnDz and mixtures thereof wherein the A are independently selected ligands having organo groups with a sufficient number of carbon atoms to render the compound soluble or dispersible in the oil, n is from 1 to 4, k varies from 4 to 7, D is selected from the group of neutral electron donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Where the hydrocarbonaceous liquid is a lubricating oil, it preferably contains at least 10 ppm, at least 30 ppm, at least 40 ppm and more preferably at least 50 ppm molybdenum. Suitably, such lubricating oil compositions contain no more than 1000 ppm, no more than 750 ppm or no more than 500 ppm of molybdenum. Lubricating oil compositions useful in the present invention preferably contain from 10 to 1000, such as 30 to 750 or 40 to 500, ppm of molybdenum (measured as atoms of molybdenum).

The viscosity index of the hydrocarbonaceous liquid, and especially lubricating oils, may be increased or improved by incorporating therein certain polymeric materials that function as viscosity modifiers (VM) or viscosity index improvers (VII). Generally, polymeric materials useful as viscosity modifiers are those having number average molecular weights (Mn) of from 5,000 to 250,000, preferably from 15,000 to 200,000, more preferably from 20,000 to 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

Pour point depressants (PPDs) lower the lowest temperature at which the bulk liquid flows and may also be present, especially in lubricating oils. PPDs can be grafted with grafting materials such as, for example, maleic anhydride, and the grafted material can be reacted with, for example, amines, amides, nitrogen-containing heterocyclic compounds or alcohol, to form multifunctional additives.

In the present invention it may be advantageous to include a co-additive which maintains the stability of the viscosity of the blend. Thus, although polar group-containing additives achieve a suitably low viscosity in the pre-blending stage, it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When hydrocarbonaceous liquids contain one or more of the above-mentioned further additives in addition to the ionic liquid, each further additive is typically blended into the bulk liquid in an amount that enables the additive to provide its desired function.

Representative effective amounts of such further additives, when used in hydrocarbonaceous liquids which are crankcase lubricants, are listed in the table below. All the values listed (with the exception of detergent values since the detergents are used in the form of colloidal dispersants in an oil) are stated as mass percent active ingredient (A.I.). These amounts of further additives are used in combination with the amount of ionic liquid hereinbefore described.

| Additive | Mass % (Broad) | Mass % (Preferred) |
|---|---|---|
| Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2.5 |
| Pour Point Depressant | 0.01-5 | 0.01-1.5 |
| Antifoaming Agent | 0-5 | 0.001-0.15 |
| Friction Modifier | 0-5 | 0-1.5 |
| Viscosity Modifier | 0.01-10 | 0.25-3 |
| Ionic Liquid | 0.1 to 5.0 | 0.1 to 3 |
| Hydrocarbonaceous Liquid (basestock) | Balance | Balance |

Definitions

For purposes of this specification and all claims to this invention, the following words and expressions, if and when used, have the meanings ascribed below.

For purposes herein, the new numbering scheme for the Periodic Table of the Elements is referred to as set out in CHEMICAL AND ENGINEERING NEWS, 63(5), 27 (1985). Alkali metals are Group 1 metals (e.g., Li, Na, K, etc.). Alkaline earth metals are Group 2 metals (e.g., Mg, Ca, Ba, etc.)

The term "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies.

The term "mass %" means mass percent of a component, based upon the mass of the composition as measured in grams, unless otherwise indicated, and is alternately referred to as weight percent ("weight %", "wt %" or "% w/w").

The term "absent" or "free" as it relates to components included within the lubricating oil compositions described herein and the claims thereto means that the particular component is present at 0 wt %, based upon the weight of the lubricating oil composition, or if present in the lubricating oil composition the component is present at levels that do not impact the lubricating oil composition properties, such as less than 10 ppm, or less than 1 ppm or less than 0.001 ppm. The term "absent" or "free" as it relates to amounts of aged components and nitrogen dioxide contamination means levels that do not impact the lubricating oil composition properties, such as less than 10 ppm, or less than 1 ppm or less than 0.001 ppm.

Unless otherwise indicated, all percentages reported are mass % on an active ingredient basis, i.e., without regard to carrier or diluent oil, unless otherwise stated.

This invention further relates to:

1. A method of limiting the chemical degradation of a hydrocarbonaceous liquid in service at bulk liquid temperatures of 60° C. or more (such as 110° C. or more, such as from 60 to 180° C.), the degradation being initiated by nitration of the liquid resulting from contamination with nitrogen dioxide in service, comprising:

preparing, or obtaining a freshly prepared, hydrocarbonaceous liquid suitable for service at bulk liquid temperatures of 60° C. or more (such as 110° C. or more, such as from 60 to 180° C.) and being substantially free of aged components and nitrogen dioxide contamination;

adding to said hydrocarbonaceous liquid, prior to service at bulk liquid temperatures of 60° C. or more (such as 110° C. or more, such as from 60 to 180° C.), an ionic liquid comprising, such as composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring, and this conjugated system bearing the anionic charge;

wherein the ionic liquid is added in an amount effective to thereafter inhibit the nitration of the hydrocarbonaceous liquid in service at bulk liquid temperatures of 60° C. or more (such as 110° C. or more, such as from 60 to 180° C.) in the presence of nitrogen dioxide contamination; and putting said hydrocarbonaceous liquid into service, wherein the ionic liquid thereby limits the resulting chemical degradation of the liquid.

2. The method of paragraph 1, wherein the chemical degradation is that resulting from the decomposition of hydrocarbonaceous nitrate esters formed in service by the nitration of the hydrocarbonaceous liquid by nitrogen dioxide at bulk liquid temperatures of 60° C. or more (such as 110° C. or more, such as from 60 to 180° C.); and wherein the ionic liquid is added in an amount determined to inhibit the formation of hydrocarbonaceous nitrate esters in that service.

3. The method of paragraph 2, wherein the decomposition of the hydrocarbonaceous nitrate esters results from the hydrocarbonaceous liquid being periodically or continuously subjected in service to bulk liquid temperatures of between 110 and 160° C.; and wherein the ionic liquid is added in an amount determined to inhibit the formation of hydrocarbonaceous nitrate esters in that service.

4. The method of paragraph 2 or paragraph 3, wherein the inhibition of hydrocarbonaceous nitrate ester formation in service is determined by the observance of a lower nitrate ester peak height in the presence of the ionic liquid, as measured by infrared spectroscopy according to DIN 51 453 or ASTM D8048-20, under like conditions of service and nitrogen dioxide contamination.

5. The use of an ionic liquid as an additive to limit the chemical degradation of a hydrocarbonaceous liquid in service at bulk liquid temperatures of 60° C. or more (such as 110° C. or more, such as from 60 to 180° C.), the degradation being initiated by nitration of the hydrocarbonaceous liquid resulting from contamination with nitrogen dioxide in service, the ionic liquid comprising, such as being composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring and this conjugated system bearing the anionic charge;

wherein the ionic liquid is added to a hydrocarbonaceous liquid free of aged components and nitrogen dioxide contamination prior to service, and wherein the ionic liquid thereafter inhibits the nitration of the hydrocarbonaceous liquid in service at bulk liquid temperatures of 60° C. or more (such as 110° C. or more, such as from 60 to 180° C.) in the presence of nitrogen dioxide contamination.

6. The use of paragraph 5, wherein the chemical degradation is that resulting from the decomposition of hydrocarbonaceous nitrate esters formed in service by the nitration of the hydrocarbonaceous liquid by nitrogen dioxide at bulk liquid temperatures of 60° C. or more (such as 110° C. or more, such as from 60 to 180° C.); and wherein the ionic liquid inhibits the formation of those hydrocarbonaceous nitrate esters in that service.

7. The use of paragraph 6, wherein the decomposition of the hydrocarbonaceous nitrate esters results from the hydrocarbonaceous liquid being periodically or continuously subjected in service to bulk liquid temperatures of between 110 and 160° C.; and wherein the ionic liquid inhibits the formation of hydrocarbonaceous nitrate esters in that service.

8. The use of paragraph 6 or paragraph 7, wherein the inhibition of hydrocarbonaceous nitrate ester formation in service is determined by the observance of a lower nitrate ester peak height in the presence of the ionic liquid, as measured by infrared spectroscopy according to DIN 51 453 or ASTM D8048-20, under like conditions of service and nitrogen dioxide contamination.

9. The method or use of any preceding paragraph wherein each cation (i) consists of a substituted ammonium cation, or an alicyclic or aromatic ring system incorporating nitrogen and bearing the cationic charge.

10. The method or use of paragraph 9 wherein each cation (i) is a tetra-substituted ammonium cation.

11. The method or use of any of the preceding paragraphs 1 to 8 wherein each cation (i) of the ionic liquid is nitrogen-free.

12. The method or use of any of the preceding paragraphs 1 to 8 and 11 wherein each cation (i) of the ionic liquid consists of a tetra-hydrocarbyl substituted central atom or ring system bearing the cationic charge.

13. The method or use of paragraph 11, or of paragraph 12 when read with paragraph 11, wherein each cation (i) of the ionic liquid is a tetra-alkyl substituted phosphonium cation.

14. The method or use of any preceding paragraph wherein each anion (ii) of the ionic liquid is nitrogen-free.

15. The method or use of any preceding paragraph wherein each anion (ii) of the ionic liquid is sulfur-free.

16. The method or use of any preceding paragraph wherein the aromatic ring of each anion (ii) of the ionic liquid bears a carboxylate group and a further heteroatom-containing functional group bonded directly to the aromatic ring.

17. The method or use of paragraph 16 wherein the one or more anions (ii) of the ionic liquid are one or more salicylate anions.

18. The method or use of any preceding paragraph wherein the aromatic ring of each anion (ii) of the ionic liquid additionally bears one or more hydrocarbyl substituents.

19. The method or use of paragraph 18 wherein the aromatic ring of each anion (ii) of the ionic liquid bears one or more straight- or branched-chain alkyl substituents having more than 10 carbon atoms.

20. The method or use of paragraph 19 wherein the one or more anions (ii) of the ionic liquid are one or more alkyl-substituted salicylate anions, and wherein the alkyl substituent(s) of each anion are independently selected from alkyl groups containing from 12 to 24 carbon atoms.

21. The method or use of paragraph 20, wherein each cation (i) of the ionic liquid is a trihexyltetradecyl-phosphonium cation.

22. The method or use of any preceding paragraph wherein the hydrocarbonaceous liquid is a lubricating oil for a mechanical device.

23. The method or use of paragraph 22 wherein the hydrocarbonaceous liquid is a crankcase lubricating oil for an internal combustion engine, and is subjected in service to nitrogen dioxide contamination originating from exhaust gas and periodically or continuously to bulk liquid temperatures in the crankcase of between 110 and 160° C.

24. The method or use of any preceding paragraph wherein the amount of ionic liquid added to the hydrocarbonaceous liquid to is in the range of 0.1 to 5.0% by weight, per weight of hydrocarbonaceous liquid.

25. The nitration-resistant hydrocarbonaceous liquid obtained or obtainable by the method or use of any preceding paragraph.

26. An additive concentrate composition for a hydrocarbonaceous liquid, comprising an ionic liquid composed of:

(i) one or more organic cations each comprising a central atom or ring system bearing the cationic charge and multiple pendant hydrocarbyl substituents, and (ii) one or more halogen- and boron-free organic anions each comprising an aromatic ring bearing at least two substituent functional groups containing heteroatoms, these functional groups being conjugated with the aromatic ring and this conjugated system bearing the anionic charge;

the concentrate further comprising a carrier liquid and, optionally, further additives.

27. The additive concentrate of paragraph 24, comprising the ionic liquid defined in any of paragraphs 9 to 21.

EXAMPLES

The practice and advantages of the present invention are now illustrated by way of examples.

For purposes of this invention and the claims thereto, determining the amount of reduction or limitation of nitrate ester formation in a lubricating oil composition is determined by the observance of a lower (such as by at least 10%, such by at least 20%, such as by at least 30%, such as by at least 40%, such as by at least 50%, such as by 100%) nitrate ester peak height in the presence of the lubricating oil composition containing ionic liquid (as compared to the nitrate ester peak of the same lubricating oil composition where the ionic liquid is replaced with an ionic liquid having the same cation, but hexanoate as the anion in the same proportions), as measured by infrared spectroscopy according to DIN 51 453 or ASTM D8048-20, under like conditions of service and nitrogen dioxide contamination, provided that in the event of conflicting results between DIN 51 453 and ASTM D8048-20, DIN 51 453 shall control.

Example 1—Preparation of Ionic Liquids

Ionic liquids were synthesised using the following method deploying an ion-exchange resin.

Example 1.1: [P66614][Salicylate] (Example of the Invention)

[P66614][Salicylate] was produced using a two-step synthesis method starting from commercially available trihexyltetradecylphosphonium chloride, [P66614][Cl] (CYPHOS IL-101, >95%, CAS: 258864-54-9).

In the first step, [P66614][OH] was synthesized from [P66614][Cl] using a commercially available basic anion exchange resin (Amberlite IRN-78, OH-form resin, CAS: 11128-95-3). [P66614]Cl (100 g, 0.193 mol) was added to a 2 L round-bottom flask and diluted with absolute ethanol (900 mL, 19.5 mol, CAS: 64-17-5). To this, 100 g of the ion exchange resin was added, and the mixture was stirred for 5 hours at 22° C. The resin was then filtered off, and 100 g of fresh resin was added. This step was repeated three times, or until a negative silver halide test was observed, indicating complete ion exchange.

The silver halide test was carried out as follows: a small aliquot (0.2 mL) of the reaction mixture was transferred to a 2 mL vial, and diluted with 1 mL absolute ethanol. 2-3 drops of HNO3 were added to acidify the solution, and 2-3 drops of a saturated aqueous solution of AgNO3 (≥99 wt. %, Sigma-Aldrich, CAS: 7761-88-8) was subsequently added. Complete ion exchange was indicated when a transparent solution with no precipitate was observed.

In the second step, the concentration of [P66614] [OH] in ethanol was determined using 1H NMR. This was followed by the dropwise equimolar addition of commercially available salicylic acid (≥99.0 wt. %, CAS: 69-72-7) dissolved in 100 mL ethanol (26.6 g, 0.193 mol of salicylic acid for 100% yield), which was subsequently stirred overnight at 22° C. The solution was then dried under rotary evaporation and subsequently in vacuo (10-3 Pa) at 50° C. for a minimum of 96 h, to obtain the dry pure ionic liquid (determined by NMR a follows):

[P66614][Salicylate]: 1H NMR (500 MHz, DMSO-d6): δ (ppm)=0.87 (s, 12H, CH3-(P)), 1.24-1.58 (m, 48H, —CH2-(P)), 2.17 (s, 8H, —CH2-(P)), 6.62 (m, 2H), 7.17 (m, 1H), 7.65 (m, 1H); 13C NMR (126 MHz, DMSO-d6): δ (ppm) =13.86, 13.95, 17.14, 17.28, 17.56, 17.65, 20.50, 21.81, 22.10, 28.08, 28.63, 28.72, 28.96, 29.05, 29.68, 29.80, 30.40, 31.30 116.00, 129.92, 131.97, 162.79, 171.31.

Example 1.2: [P66614][Alkyl-Salicylate] (Example of the Invention)

[P66614][Alkyl-Salicylate] was synthesised via the procedure used for [P66614][Salicylate] in Example 1.1. [P66614][OH] was firstly prepared from [P66614][Cl] (100 g, 0.193 mol). The alkyl-salicylic acid used in the second step in place of the salicylic acid from Example 1.1 was a commercial sample provided by Infineum UK Ltd, being a mono-alkyl salicylic acid mixture bearing alkyl substituents of 14 and 16 carbon atoms. In this case, the acid number of the salicylic acid (0.00261 g H+/mol) was used to calculate the amount of acid required (equimolar) for the neutralisation reaction, which was 73.96 g.

Following drying the material was characterised via NMR:

[P66614][Alkyl-Salicylate]: 1H NMR (500 MHz, DMSO-d6): δ (ppm)=0.69-0.88 (s), 1.04-1.29 (m), 1.37 (m), 1.46 (m), 2.15 (m), 2.29 (s), 3.34 (s), 3.43 (m), 4.36 (s), 6.49 (m), 6.72 (m), 6.93 (m), 7.18 (m), 7.25 (m), 7.41 (s), 7.47 (m), 7.65 (s), 7.70 (s), 8.16 (s), 9.07 (s), 9.11 (s), 9.15 (s).

A further sample of [P66614][Alkyl-Salicylate] was prepared by the following scaled up procedure.

[P66614][Cl] (808 g, 1.56 mol) was charged into a 5 L glass reactor and diluted with absolute ethanol (770 mL, 13.2 mol). To this solution was dosed a pre-prepared solution of KOH (87.3 g, 1.56 mol) in absolute ethanol (770 mL, 13.2 mol) over 28 minutes using a water bath to limit the exotherm to 23° C. The mixture was aged for between 90 and 250 min and then blended with celite filter aid (164 g, 20 mass %) and filtered to remove KCl, rinsing the filter cake with absolute ethanol (160 mL, 2.74 mol). The filtrate was transferred to a clean 5 L glass reactor and treated with Amberlite ion exchange resin IRN-78 (400 g, 50 mass %) for 30-70 min and then separated by filtration, rinsing the resin with absolute ethanol (2×160 mL, 2×2.74 mol). The filtrate was transferred to a clean 5 L glass reactor, into which was dosed an equimolar amount of the same alkylsalicylic acid as a xylene solution over 33 min using a water bath to limit the exotherm to 28° C. The mixture was aged for 16 hours and then the volatile components were removed via rotary evaporation at 60-80° C. at 10 mbar for min. 3 h.

Example 1.3a: [P66614][Hexanoate] (Comparative Example)

[P66614][Hexanoate] was synthesised via the procedure used for [P66614][Salicylate] in Example 1.1. [P66614][OH] was firstly prepared from [P66614][Cl] (100 g, 0.193 mol). Equimolar addition of hexanoic acid (≥99 wt. %, CAS: 142-62-1) in place of salicylic acid in the second step (22.4 g, 0.193 mol) was used to produce the desired ionic liquid, followed by drying.

Example 1.3b: [P66614][Alkanoates] (Further Comparative Examples)

Using the procedure in Example 1.3a, three further [P66614][Alkanoates] were prepared from commercial grades of acetic acid (≥99.7 wt. %, CAS: 64-19-7), dodecanoic acid (98 wt. %, CAS: 143-07-7), and octadecanoic acid (95 wt. %, CAS: 57-11-4) respectively. The resulting ionic liquids were [P66614][Acetate], [P66614][Dodecanoate] and [P66614] [Octadecanoate] respectively.

Example 1.4: [P66614][$NTf_2$] (Comparative Example)

Trihexyltetradecylphosphonium chloride, [P66614][Cl] (100 g, 0.193 mol) was dissolved in a minimum amount of dichloromethane (>99%, CAS: 75-09-2), in a 1 L round-bottom flask. To this, an aqueous solution of commercially available LiNTf2 (55.3 g, 0.193 mol; 99 wt. %, CAS: 90076-65-6) was added dropwise. The reaction mixture was stirred for 12 h at 22° C., forming a biphasic solution. The organic layer was extracted and washed with ultrapure water five times to remove the LiCl by-product, and until a negative halide test was observed. The solution was then dried under rotary evaporation and subsequently in vacuo (10-3 Pa) at 50° C. for a minimum of 96 hours, to obtain dry pure trihexyltetradecylphosphonium bis(trifluoromethanesulfonyl)imide, [P66614][NTf2], determined by NMR as follows:

[P66614][NTf2]: 1H NMR (500 MHz, $CDCl_3$): δ (ppm) =0.88 (m, 12H, CH3-(P)) 1.23-1.29 (m, 32H, —CH2-(P)), 1.46 (m, 16H, —CH2-(P)), 2.08 (m, 8H, —CH2-(P)); 13C NMR (126 MHz, CDCl3): δ (ppm)=13.85, 14.12, 18.56, 18.94, 21.55, 22.28, 22.69, 28.80, 29.25, 29.36, 29.49, 29.65, 30.17, 30.52, 30.89, 31.92, 118.62, 121.17.

The ionic liquids prepared by these syntheses were used in the further examples below.

Example 2—Enhanced Uptake of Nitrogen Dioxide by Ionic Liquids Deployed in the Present Invention The intrinsic affinity for nitrogen dioxide shown by various ionic liquids synthesised in Example 1 was determined gravimetrically, measuring the uptake of nitrogen dioxide by mole, per mole of pure ionic liquid.

The gravimetric NO2 uptake measurements of the synthesised ionic liquids were comprised of a desorption step, followed by an absorption step, as below. The ionic liquid was used after being dried in vacuo, and transferred to a glass flask and sealed. A gas system was used to control the required gas feeds (pure argon, and a mixture of argon and 1% NO2 (in argon) to produce a 0.2% NO2 feed).

Desorption Step

The ionic liquid was weighed out (~0.5 g±0.1 mg) into a vial (1.9 cm3 volume) with a stirrer bar and sealed with a septum cap. Two needles were pierced through the septum; one needle acted as a gas inlet and was placed at the bottom of the vial, and the second needle acted as an outlet, placed in the vial above the surface of the ionic liquid. Flexible gas tubing (corrosion-resistant) was then connected to the inlet and the vial was placed in an oil bath heated to 80° C. (±0.5° C.) with stirring, where it was purged with Ar at a flow rate of 50 cm3·min-1 to remove any remaining volatiles/water. The vial was removed hourly, cleaned and weighed, until it was noted that the weight had stabilized over two consecutive readings.

Absorption Step

After desorption, the vial was subsequently purged with 0.2% NO2 in Ar under a flow rate of 40 cm3·min-1 at 22±0.5° C. Gas uptake was monitored after 15, 30, 60 min and then hourly, until the weight was observed to have stabilised. The weight gain was used to calculate the amount of NO2 absorbed (accounting for the mass of the headspace). The mass of the ionic liquid was measured with an uncertainty close to 10-4 g leading to an overall uncertainty of better than 0.01ηNO2:η ionic liquid (ratio of moles of NO2 to moles of IL).

FIG. 1 shows the results of this gravimetric testing for ionic liquids synthesised in Example 1 and commonly based around the trihexyltetradecyl-phosphonium ("P66614") cation, but differing in their anion composition.

As shown in FIG. 1, the molar uptake of nitrogen dioxide per mole of ionic liquid (i.e., in ηNO2/η ionic liquid) by Example 1.1, an ionic liquid of the invention wherein the anion was a salicylate anion, was substantially higher than for comparative ionic liquids from Example 1.3 based on anions of the structure RCOO(—) in which R is a variety of alkyl groups, as taught in the disclosures of WO-A-2008/075016 and WO-A-2013/158473. The salicylate anion (based on a C6 aromatic ring) of Example 1.1 in particular showed greater intrinsic affinity for nitrogen dioxide over time than the analogous ionic liquid of Example 1.3a based on hexanoate (C6 alkyl group). The similar carbon numbers of these two anions emphasise the differential abilities of these ionic liquids of different anionic structure to take up nitrogen dioxide.

Furthermore, the nitrogen dioxide uptake of ionic liquid Example 1.2 composed of alkyl-substituted salicylate, whilst slower in onset, continued to rise above the plateau uptake level quickly reached by the comparative hexanoate ionic liquid Example 1.3a. The slower rate is believed to result from the kinetic factor of higher neat liquid viscosity and hence slower physical gas absorption characteristics, is thus more than compensated for in time by the greater intrinsic (thermodynamic) affinity for nitrogen dioxide shown by the anion structure in the ionic liquid of the invention. Indeed the slower kinetics, which initially hide the greater affinity which manifests itself over time, make the hydrocarbyl-substituted embodiment of the anion particularly suitable for environments where nitrogen dioxide contamination accumulates gradually and where a long service life is important, such as in a crankcase lubricating oil.

In addition, the ionic liquids of the invention (Examples 1.1 and 1.2) were substantially superior to comparative Example 1.4 made from the anion [NTf2] (i.e., bis(trifluoromethanesulfonyl)imide), which showed essentially no uptake of nitrogen dioxide under comparable conditions.

The ionic liquids deployed in the present invention thus have advantageously-high intrinsic affinity for nitrogen dioxide.

Example 3—Mechanistic Evaluation of Ionic Liquids Deployed in the Invention

To evaluate the effectiveness and mechanism of the ionic liquid of the invention, the onset and progress of nitration in a hydrocarbonaceous liquid subject to nitrogen dioxide contamination can be observed and measured using infrared spectroscopy.

Monitoring the progressing nitration of the hydrocarbonaceous liquid involves taking periodic samples of the liquid in use under real or simulated service conditions, and following the evolution of the fingerprint nitration peak height on the infrared spectrum. The rate of increase of the nitration peak height provides information on the rate of chemical degradation due to nitration and build-up of the nitrate ester reservoir in the bulk liquid.

According to the DIN 51453 peak height method [Standard DIN 51453 (2004-10): Testing of lubricants—Determination of the oxidation and nitration of used motor oils—Infrared spectrometric method], the height of a single infrared absorption frequency at 1630 cm-1 attributable to forming hydrocarbonaceous nitrate ester is measured above a straight-line baseline defined by the absorptions at 1615 and 1645 cm-1. The higher the peak height, the more hydrocarbonaceous nitrate ester is present in the bulk liquid. The above DIN method also provides for monitoring of the progress of conventional oxidation of the bulk liquid via the measurement of peak height at 1710 cm-1 attributable to carbonyl moieties (ketones, aldehydes, esters and carboxylic acids) formed as a result of oxidation. This peak height is measured relative to a straight-line baseline defined by absorptions at 1970 and 1650 cm-1. Again the rate of increase of peak height provides information on the rate of chemical oxidation in the bulk liquid.

According to ASTM D8048-20 Standard test method for evaluation of diesel engine oils in Volvo (Mack) T-13 diesel engines, oxidation and nitration peak heights are measured by first subtracting the fresh oil infrared spectrum. The baseline is defined by absorption between 1950 cm-1 and 1850 cm-1 with highest peak in the range 1740 cm-1 to 1700 cm-1 used for oxidation and 1640 cm-1 to 1620 cm-1 for nitration.

Samples of hydrocarbonaceous liquid being tested under service conditions can be measured via the above methods, and allow the reporting of the effect of different ionic liquids present in the hydrocarbonaceous liquid on the progress, and/or level of inhibition, of degradation due to nitration and due to oxidation.

Mechanistic Evaluation of Ionic Liquids Deployed Under the Invention

Example 3.1—Anion Contribution Towards Inhibiting Degradation Caused by Nitration The DIN 51453 method was used to illustrate the contribution of the anion of the ionic liquid in the performance of the present invention. Testing was conducted on a freshly-prepared lubricating oil as bulk hydrocarbonaceous liquid, this composition containing a conventional package of commercial additives.

To this starting oil composition was added 2% by mass, per mass of the oil, of the ionic liquid Example 1.2 of this invention, being composed of the tetraalkylphosphonium cation "P66614" and an alkyl salicylate anion. A comparative test sample was prepared from the same starting oil composition by instead adding 2% by mass, per mass of oil, of an ionic liquid composed of Example 1.4, having the same P66614 cation but an NTf2 anion [Trihexyltetradecylphosphonium bis(trifluoromethanesulfonyl)imide]. The starting oil composition was also used as a control run to set the baseline offered by a commercial formulated oil.

The test samples were subjected to a laboratory simulation of service conditions as an engine lubricant, in which the oil was exposed to sump operating temperatures and exposed to a source of nitrogen dioxide to mimic contamination in service. This simulation comprises a three-necked 250 mL conical flask fitted with a glycol condenser and heated on an electrical hot-plate. Gas containing 766 ppm NO2 in air is bubbled through 250 g of the test lubricant at a rate of 10 litres per minute. A sintered glass frit is used to disperse the gas in the oil. The gas flow rate is regulated using a mass flow controller. The third neck is used to introduce a thermocouple which feeds-back to the hotplate to maintain constant temperature. The test samples were each run for 96 hours at 130° C., and the nitration and oxidation peak heights determined at the end of the test by the above DIN 51453 method. The results for the two samples containing ionic liquid were then compared with the control oil formulation, and the impact of their respective ionic liquids reported as percentage reductions in nitration and oxidation peak height against the control.

Results

| | peak height % reduction vs control | |
|---|---|---|
| 2% treat rate by mass of ionic liquid | Oxidation | Nitration |
| Example 1.2 - [P66614][Ntf2] | 59 | 43 |
| Example 1.4 - [P66614][Alkyl-Salicylate] | 70 | 70 |

The presence of the P66614 alkyl salicylate ionic liquid of the invention resulted in substantially greater reduction in nitration peak height than the comparative ionic liquid with identical cation but anion not according to the present invention. These results support the differential effect of anion composition observed by gravimetric analysis in Example 2, and demonstrate the significant advantage provided by the anion defined in the present invention for deactivating nitrogen dioxide entrained in the bulk liquid.

Whilst the present invention also showed a substantial reduction in oxidation peak height, the oxidation results showed less differentiation between the two ionic liquid samples, supporting the existence of different chemical pathways to nitration and classical oxidation of the lubricant. The differential benefit for the present invention towards nitration indicates its higher selectivity for inhibiting the nitration pathway and greater suitability for controlling the effect of nitrogen dioxide contamination under service.

Example 3.2—Cation Contribution Towards Inhibiting Degradation Caused by Nitration The DIN 51453 method and laboratory test method of Example 3.1 was also used to illustrate the contribution of the cation of the ionic liquid in the performance of the present invention. Testing was again conducted on the freshly prepared formulated lubricating oil as bulk hydrocarbonaceous liquid containing a conventional package of commercial additives. To this starting composition was added 2% by mass, per mass of the oil, of ionic liquid Example 1.2 of this invention, being composed of the tetraalkylphosphonium cation "P66614" and an alkyl salicylate anion. However, the comparative test sample was prepared from the same starting oil composition by adding the alkyl salicylic acid from which the ionic liquid had been prepared, in an amount equivalent to the amount of anion in the ionic liquid sample. Thus, in this case, the same aromatic ring structure was added to the oil, in the same amount, but the cation was omitted. The starting oil composition was again used as a control.

The test samples were subjected to the same laboratory simulation of service conditions as an engine lubricant, in which the oil was exposed to sump operating temperatures and exposed to a source of nitrogen dioxide to mimic contamination in service. The test samples were each run for 96 hours at 130° C., and the nitration and oxidation peak heights determined at the end of the test by the above DIN method. The results for the two samples were then compared with the control oil, and their impact reported as percentage reductions in nitration and oxidation peak height against the control:

Results

| | peak height % reduction vs control | |
|---|---|---|
| 2% treat rate by mass of ionic liquid | Oxidation | Nitration |
| Example 1.2 - [P66614][Alkyl-Salicylate] | 70 | 70 |
| 0.84% Alkyl-Salicylic acid | 34 | 27 |

The results demonstrate that whilst alkyl-salicylic acid itself brought about some reduction in nitration, the ionic liquid was a more potent inhibitor of nitration. This performance advantage was much more apparent for nitration than for oxidation. The full nitration-inhibiting effect of the ionic liquid of the present invention is therefore attributable to the ion-pair combination in the ionic liquid, which co-operate to deactivate nitrogen dioxide present in the bulk liquid. Further investigation of the mechanism of this combination effect was carried out in the same laboratory simulation test using the same freshly prepared lubricating oil composition, this time treated with the ionic liquid P66614 Cl. This comparative ionic liquid did not give as much reduction in nitration peak height as the alkyl salicylate example of the invention, but nevertheless still reduced the nitration level by over 60% as compared to the control lacking this ionic liquid.

Compositional analysis of the bulk oil composition at the end of the test showed a decrease in chloride concentration in the oil over the course of the test; and a gas purge through the end-of-test bulk oil and into silver nitrate solution confirmed the formation of hydrochloric acid during the test. Thus, the P66614 cation is considered to complex with nitric acid formed in situ from a proportion of the nitrogen dioxide, this complex rearranging to the [P66614][nitrate] ion pair and releasing HCl. In this way, the cation of the ionic liquid also serves to lock away some nitrogen dioxide in a deactivated form, reducing the effective contaminant level and slowing the resulting degradation.

In the practice of the present invention, the advantages of the defined ionic liquid thus result from the co-operative effect of the defined anion's particularly high affinity for sequestering away nitrogen dioxide, coupled with the ability of the associated cation to form a stable complex with nitrate ions formed in situ from a proportion of the nitrogen dioxide, which further reduces the available nitrogen dioxide concentration within the bulk liquid. This combined effect produces particularly good inhibition of the nitration, and hence degradation, caused by nitrogen dioxide in the bulk liquid. This effect likewise provides for slower increases in total acid number in the bulk liquid, and reduces the potential for the consequences of nitration and acidification, such as bulk liquid viscosity growth.

Example 4—Performance of the Invention in Controlling Degradation Under Service Conditions The advantageous nature of the present invention is illustrated by testing under real service conditions.

For these purposes, an engine lubricating oil was used as the hydrocarbonaceous liquid and the service environment chosen was the ASTM D8048-20 Standard test method for evaluation of diesel engine oils in Volvo (Mack) T-13 diesel engines. The test uses a 2010 Volvo/Mack D13/MP8, 505BHP, 13 L in-line six-cylinder diesel engine with electronically controlled fuel injection, with six electronic unit injectors, VGT (variable geometry turbocharger), and cooled EGR (exhaust gas recirculation). It is a 360 hour test run at 1500 RPM steady state conditions producing approximately 2200 Nm torque and 130° C. oil temperature with 19-20% EGR. The principal aim is to evaluate the oxidation stability performance of engine oils at an elevated oil temperature using ULSD (ultra-low sulfur diesel) fuel. The T13 engine test was chosen in view of its known-in-the-art characteristics of high operating temperatures and representative engine-out NOx emissions. The engine (crankcase) lubricating oil of the T13 test is thus exposed in service to higher bulk temperatures in the sump and to nitrogen dioxide contamination via direct entrainment in the lubricant draining down from the cylinder walls, and exhaust gas blowby past the piston rings into the crankcase.

The T13 test provides an endurance test for the lubricant under conditions that promote chemical degradation due to nitration initiated by nitrogen dioxide contamination. To increase the endurance element of the test further, its normal duration of 360 hours was extended to 400 hours in some cases below. Periodically during the test, the oil is sampled and nitration and oxidation peak heights measured by infrared spectroscopy using the ASTM D8048-20 Mack (Volvo) T13 oxidation method described in application 3 above. The rise in total acid number (TAN ASTM D664) over the test and the increase in viscosity (ASTM D445) of the oil at 40° C. and 100° C. were also measured.

Three T13 tests were conducted to compare the effects of different additives to controlling chemical degradation due to nitration and ultimate oxidation. In each case, the same freshly prepared starting lubricating oil composition was used, being a conventional lubricant base oil base-stock containing a standard commercial package of additives. To this starting composition was added one further material in each test, and the effects of these materials compared.

In Oil 1 (comparative), the further material was comparative ionic liquid from the prior art, being composed of the tetra-alkylphosphonium cation "P66614" and a hexanoate anion. This ionic liquid was used at the treat rate of 2% by mass, per mass of lubricating oil composition, and was produced in preparative Example 1.3a as hereinbefore described.

In Oil 2 (comparative), the further material was a commercial antioxidant additive composed of a hindered phenolic compound. This material is known to be an effective control on conventional free-radical based oxidation processes.

In Oil 3 (invention), the further material was an ionic liquid from the present invention, being composed of the tetraalkylphosphonium cation "P66614" and an alkyl salicylate anion. This ionic liquid was used in the lubricating oil composition at equimolar concentration to the [P66614][hexanoate] ionic liquid used in the first case, approximating to a treat rate of 2.8% by mass, per mass of lubricating oil composition. This ionic liquid was produced by the scaled up process in preparative Example 1.2 as hereinbefore described.

The results over the course of the T13 tests are shown graphically in FIGS. 2, 3, and 4 for nitration, oxidation and increase in kinematic viscosity at 100° C. respectively.

In FIG. 2, all three test compositions showed an increase in nitration peak height as the test progressed, with some nitration occurring due to the contamination by nitrogen dioxide. However, Oil 2 containing the conventional antioxidant generally showed the fastest growth in nitration peak height, which accelerated from the 300 hour point of its test. This test run was accordingly stopped at the normal 360 hour point, with the nitration peak height at over 40.

The progress of nitration was generally slower with the ionic liquid-treated Oils 1 and 3, however the nitration rate with hexanoate-based ionic liquid (Oil 1) also increased after the 200 hour mark, and by 360 hours had exceeded 30 on nitration peak height. In contrast, the alkyl salicylate-based ionic liquid (Oil 3) retained a slow and steady gradient throughout the 360 hours normal duration, and by that point had only just exceeded 20 on nitration peak height, less than half the nitration of the conventional antioxidant Oil 2, and substantially less than Oil 1. By 400 hours the nitration level of Oil 3 was still significantly less than that of Oil 1.

Thus, in the real service conditions of the engine, under hot sump temperatures and in the presence of nitrogen dioxide contamination, the present invention showed substantially improved ability to inhibit nitration over the conventional antioxidant additive solution. It also showed significantly better performance than an analogous alkylcarboxylate ionic liquid, demonstrating the benefit arising from its different composition.

Likewise FIG. 3 shows that both the conventional antioxidant solution (Oil 2) and the hexanoate-based ionic liquid (Oil 1) showed rapid increase in oxidation towards the end of the test, as the oils lost their oxidation control and oxidation peak height rose sharply. In contrast, Oil 3 retained excellent oxidation control right through to the 360 hour mark, and by 400 hours was still showing significantly lower oxidation than either comparative oil.

The slower growth in nitration peak height and consequently oxidation peak height exhibited by Oil 3 likewise demonstrates the greater efficacy of the present invention to inhibit the chemical degradation of the bulk liquid (lubricating oil) caused by nitrogen dioxide contamination during service. The slower growth in nitration peak height over time records a slower build-up of nitrate esters in the bulk liquid and, consequently, a slower onset of chemical degradation due to nitration, allowing the liquid to remain in service for longer.

The rise in kinematic viscosity of the oils over the course of the tests is shown in FIG. 4, and also diverged between the two ionic liquids. The kinematic viscosity of Oil 1 rose steeply towards the end of the test, as this oil lost its control of the degradative processes. In contrast, Oil 3 of the invention maintained an essentially flat viscosity for the whole duration of the test. The higher initial viscosity of the ionic-liquid treated oils in these tests arises from the direct viscosity effect of the addition of the ionic liquid without adjustment to the underlying oil composition, in order to avoid introducing other variables, and would be formulated out in commercial practice of the invention by viscometric adjustments to the underlying oil composition.

The oil of the invention showed improved total acid number control over the analogous hexanoate-based ionic liquid. At the end of the test, Oil 3 had a TAN of only 2.8 at the normal end of test point of 360 hours, and a TAN of 4.2 at the end of the 400 hours extended test; whereas by 360 hours the TAN of Oil 1 had already risen to 8.32, so this test was not extended further.

Thus, the present invention (Oil 3) also provided advantages over Oil 1 in terms of both viscosity control and total acid number control, providing formulating benefits to the user.

Further examples with different cations with the NTf2 anion were run.

INOx Results

| | peak height % reduction vs control | |
|---|---|---|
| treat rate by mass of ionic liquid | Oxidation | Nitration |
| 2.6% [P66614][Ntf2] | 59 | 43 |
| 2% [P8888][Ntf2] | 59 | 44 |
| 2% [N8881][Ntf2] | 59 | 43 |
| 1.9% [$C_{14}$mim][Ntf2] | 69 | 51 |

Further examples of INOx results of different salicylate anions were run:

| | peak height % reduction vs control | |
|---|---|---|
| treat rate by mass of ionic liquid | Oxidation | Nitration |
| Example 1.2 - 2% [P66614][Alkyl-Salicylate] | 70 | 70 |
| 2.2% [P66614][5-NO2-Salicylate] | 53 | 68 |
| 2.2% [P66614][4-NO2-Salicylate] | 38 | 40 |
| 2.2% [P66614][4-Cl-Salicylate] | 55 | 67 |
| 2.1% [P66614][4-CH3-Salicylate] | 57 | 71 |
| 2.2% [P66614][4-CH3O-Salicylate] | 59 | 76 |
| 2.8% [P66614][3-Alkyl-Salicylate]* | 86 | 89 |
| 2.8% [P66614][4-Alkyl-Salicylate]* | 85 | 84 |
| 2.8% [P66614][5-Alkyl-Salicylate]* | 78 | 63 |
| 2.8% [P66614][6-Alkyl-Salicylate]* | 82 | 74 |

*3-/4-/5-/6-alkyl salicylates measured on different INOx rig (smaller volume run for slightly longer time).

The above examples present a range of electron donating/withdrawing substituents on the salicylate ring, as well as alkyl chains in different positions illustrating that not all salicylates will perform at the same level.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" specifies the presence of stated features, steps, integers or components, but does not preclude the presence or addition of one or more other features, steps, integers, components or groups thereof. Likewise, the term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa. Further, when a range is stated as between A and B, the range includes endpoints A and B, thus "between A and B" is synonymous with "from A to B."

What is claimed is:

1. A method of limiting the chemical degradation of a hydrocarbonaceous liquid in service at bulk liquid temperatures of from 60 to 180° C., the degradation being initiated by nitration of the liquid resulting from contamination with nitrogen dioxide in service, comprising:

preparing, or obtaining a freshly prepared, hydrocarbonaceous liquid suitable for service at bulk liquid temperatures of from 60 to 180° C. and being free of aged components and nitrogen dioxide contamination;

adding to said hydrocarbonaceous liquid, prior to service at bulk liquid temperatures of from 60 to 180° C., an ionic liquid comprising:

(i) one or more organic cations each comprising a tetra-alkyl substituted phosphonium cation, and (ii) one or more halogen- and boron-free organic anions each comprising an aromatic ring bearing at least two substituent functional groups containing heteroatoms, these functional groups being conjugated with the aromatic ring, and this conjugated system bearing the anionic charge;

wherein the one or more anions (ii) of the ionic liquid are one or more alkyl-substituted salicylate anions, and wherein the alkyl substituent(s) of each anion are independently selected from alkyl groups containing from 12 to 24 carbon atoms;

wherein the ionic liquid is added in an amount of 0.1 to 5.0% by weight, per weight of hydrocarbonaceous liquid to thereafter inhibit the nitration of the hydrocarbonaceous liquid in service at bulk liquid temperatures of from 60 to 180° C., in the presence of nitrogen dioxide contamination; and putting said hydrocarbonaceous liquid into service, wherein the ionic liquid thereby limits the resulting chemical degradation of the liquid.

2. The method of claim 1, wherein the chemical degradation is that resulting from the decomposition of hydrocarbonaceous nitrate esters formed in service by the nitration of the hydrocarbonaceous liquid by nitrogen dioxide at bulk liquid temperatures of from 60 to 180° C.; and wherein the ionic liquid is added in an amount determined to inhibit the formation of hydrocarbonaceous nitrate esters in that service.

3. The method of claim 2, wherein the decomposition of the hydrocarbonaceous nitrate esters results from the hydrocarbonaceous liquid being periodically or continuously subjected in service to bulk liquid temperatures of from 110 to 160° C.; and wherein the ionic liquid is added in an amount determined to inhibit the formation of hydrocarbonaceous nitrate esters in that service.

4. The method of claim 2, wherein the amount of reduction or limitation of nitrate ester formation in a lubricating oil composition is determined by the observance of at least a 10% a lower nitrate ester peak height in the presence of the lubricating oil composition containing ionic liquid as compared to the nitrate ester peak of the same lubricating oil composition where the ionic liquid is replaced with an ionic liquid having the same cation, but hexanoate as the anion in the same proportions, as measured by infrared spectroscopy according to ASTM D8048-20, under like conditions of service and nitrogen dioxide contamination.

5. The method of claim 1, wherein each cation (i) of the ionic liquid is nitrogen-free.

6. The method of claim 1, wherein each anion (ii) of the ionic liquid is nitrogen-free.

7. The method of claim 1, wherein each anion (ii) of the ionic liquid is sulfur-free.

8. The method of claim 1, wherein each cation (i) of the ionic liquid is a trihexyltetradecyl-phosphonium cation.

9. The method of claim 1, wherein the hydrocarbonaceous liquid is a lubricating oil for a mechanical device.

10. The method of claim 1, wherein the hydrocarbonaceous liquid is a crankcase lubricating oil for an internal combustion engine, and is subjected in service to nitrogen dioxide contamination originating from exhaust gas and periodically or continuously to bulk liquid temperatures in the crankcase of between 110 and 160° C.

11. The method of claim 1, wherein the amount of ionic liquid added to the hydrocarbonaceous liquid to is in the range of 1.0 to 3.0% by weight, per weight of hydrocarbonaceous liquid.

12. A nitration-resistant hydrocarbonaceous liquid obtained or obtainable by the method of claim 1.

13. An additive concentrate composition for a hydrocarbonaceous liquid, comprising an ionic liquid composed of:

(i) one or more organic cations each comprising a tetra-alkyl substituted phosphonium cation, and (ii) one or more halogen- and boron-free organic anions each comprising an aromatic ring bearing at least two substituent functional groups containing heteroatoms, these functional groups being conjugated with the aromatic ring and this conjugated system bearing the anionic charge;

wherein the one or more anions (ii) of the ionic liquid are one or more alkyl-substituted salicylate anions, and wherein the alkyl substituent(s) of each anion are independently selected from alkyl groups containing from 12 to 24 carbon atoms;

the concentrate further comprising a carrier liquid and, optionally, further additives; and wherein the additive concentrate composition includes from 5 to 25% by weight of the ionic liquid, per weight of the additive concentrate composition.

14. The additive concentrate of claim 13, comprising the ionic liquid of claim 1.

15. The additive concentrate of claim 13, further comprising one or more phosphorus-containing compounds; dispersants; metal detergents; anti-wear agents; friction modifiers, viscosity modifiers; and/or antioxidants provided they are different from the ionic liquid.

16. The additive concentrate of claim 15, wherein the metal detergents comprise a combination of one or more magnesium sulfonate or magnesium salicylate detergents and one or more calcium salicylate or calcium sulfonate detergents.

17. The additive concentrate of claim 15, further comprising one or more dihydrocarbyl dithiophosphate metal salts.

* * * * *